US008939281B2

(12) United States Patent
Matsuba et al.

(10) Patent No.: US 8,939,281 B2
(45) Date of Patent: Jan. 27, 2015

(54) PACKAGING

(75) Inventors: Yoko Matsuba, Tokyo (JP); Steve P. Jones, Elon, NC (US); John A. Gelardi, Midlothian, VA (US); Marty Jones, Glen Allen, VA (US); Rodney D. Dixon, Burlington, NC (US)

(73) Assignee: MeadWestvaco Corporation, Richmond, VA (US)

( * ) Notice: Subject to any disclaimer, the term of this patent is extended or adjusted under 35 U.S.C. 154(b) by 183 days.

(21) Appl. No.: 13/450,602

(22) Filed: Apr. 19, 2012

(65) Prior Publication Data

US 2012/0199581 A1 Aug. 9, 2012

Related U.S. Application Data

(63) Continuation-in-part of application No. 12/518,494, filed as application No. PCT/US2007/025198 on Dec. 10, 2007, now Pat. No. 8,251,218, application No. 13/450,602, which is a continuation-in-part of application No. PCT/US2011/038828, filed on Jun. 1, 2011.

(60) Provisional application No. 60/874,430, filed on Dec. 12, 2006, provisional application No. 61/350,158, filed on Jun. 1, 2010.

(51) Int. Cl.

| | |
|---|---|
| ***A45C 13/10*** | (2006.01) |
| ***A45C 13/18*** | (2006.01) |
| ***B65D 83/04*** | (2006.01) |
| ***B65D 85/42*** | (2006.01) |

(52) U.S. Cl.

USPC ..... 206/1.5; 206/459.1; 206/528; 206/531; 206/538; 206/540; 221/301

(58) Field of Classification Search

CPC ..... A45C 13/10; A45C 13/18; B65D 83/04; B65D 85/42

USPC ..... 206/459.1, 1.5, 528, 531, 538, 540; 221/301

See application file for complete search history.

(56) References Cited

U.S. PATENT DOCUMENTS

| | | | | |
|---|---|---|---|---|
| 4,120,400 | A * | 10/1978 | Kotyuk | 206/528 |
| 5,082,137 | A * | 1/1992 | Weinstein | 220/345.3 |
| 6,460,693 | B1 * | 10/2002 | Harrold | 206/1.5 |

(Continued)

FOREIGN PATENT DOCUMENTS

| | | | |
|---|---|---|---|
| WO | WO 9523101 | A1 * | 8/1995 |
| WO | WO2011153290 | | 12/2011 |

*Primary Examiner* — Rakesh Kumar

(74) *Attorney, Agent, or Firm* — MeadWestvaco Intellectual Property Group

(57) ABSTRACT

A package includes an outer container and an inner receptacle. The outer container forming a cavity for the inner receptacle having an open or openable end through which the inner receptacle can be inserted. The package includes a two-part locking mechanism for locking the inner receptacle within the cavity of the outer container. The outer container includes a first part of the two-part locking mechanism and the inner receptacle includes a second part of the two-part locking mechanism. The outer container includes at least one demarcated pressing zone, wherein the at least one demarcated pressing zone is configured and/or stylised and/or shaped and/or arranged to encourage a user to apply a force directed inwardly of the outer container toward the cavity for deactivating the locking mechanism to thereby release the inner receptacle for its withdrawal at least partially from the outer container.

20 Claims, 21 Drawing Sheets

(56) References Cited

U.S. PATENT DOCUMENTS

| | | | | |
|---|---|---|---|---|
| 6,641,031 | B2 * | 11/2003 | Evans et al. | 229/102 |
| 7,658,287 | B2 * | 2/2010 | Hession | 206/528 |
| 7,798,329 | B2 * | 9/2010 | Gelardi | 206/531 |
| 7,802,677 | B2 * | 9/2010 | Williams | 206/1.5 |
| 8,011,512 | B2 * | 9/2011 | Brollier et al. | 206/531 |
| 8,251,218 | B2 | 8/2012 | Gelardi | |
| 8,333,280 | B2 * | 12/2012 | Le | 206/531 |
| 8,490,794 | B2 * | 7/2013 | Kalin et al. | 206/528 |
| 8,499,936 | B2 * | 8/2013 | Albrecht et al. | 206/528 |
| 8,567,607 | B2 * | 10/2013 | Fischer | 206/531 |
| 2003/0085262 | A1 * | 5/2003 | Evans et al. | 229/102 |
| 2004/0045858 | A1 * | 3/2004 | Harrold | 206/470 |
| 2007/0045150 | A1 * | 3/2007 | Huffer et al. | 206/538 |
| 2008/0156686 | A1 * | 7/2008 | Hluchan et al. | 206/528 |
| 2009/0152134 | A1 * | 6/2009 | Katsis | 206/96 |
| 2009/0184023 | A1 * | 7/2009 | Brollier et al. | 206/531 |
| 2011/0068039 | A1 * | 3/2011 | Sack et al. | 206/531 |
| 2011/0226765 | A1 | 9/2011 | Gelardi | |
| 2012/0160726 | A1 | 6/2012 | Gelardi | |
| 2012/0234701 | A1 * | 9/2012 | Albrecht et al. | 206/1.5 |
| 2012/0267261 | A1 | 10/2012 | Gelardi | |

* cited by examiner

PACKAGING

CROSS REFERENCE TO RELATED APPLICATIONS

This application is a continuation-in-part of U.S. application Ser. No. 12/518,494, filed Jun. 10, 2009, which is a National Phase application of PCT Application Number PCT/US2007/025198, filed Dec. 10, 2007, which claims the benefit of U.S. Provisional Application No. 60/874,430, filed Dec. 12, 2006, each of which are incorporated herein by reference in their entirety. This application is also a continuation-in-part of PCT Application Number PCT/US2011/038828, filed Jun. 1, 2011, which claims the benefit of U.S. Provisional Application No. 61/350,158, filed Jun. 1, 2010, each of which are also incorporated herein by reference in their entirety.

FIELD OF THE INVENTION

The present invention relates generally to packaging, specifically but not exclusively, lockable packaging such as child-resistant, senior-friendly packages for healthcare type applications and optionally packaging such as sleeve-and-drawer style packages for consumer goods such as food, recreational drugs (e.g., tobaccos, cigars, cigarettes, etc.), toys, hardware, and electrical items, or the like. More specifically, but not exclusively, the invention relates to a sleeve-and-drawer style package having an internal slidable receptacle, that is releasably lockable within an outer shell; and to an outer shell (also referred to as a sleeve). Typical examples of sleeve-and-drawer packages where the present invention may be employed include, but are not limited to: unit dose packages for pharmaceutical tablets; capsules; lozenges; and security packages to deter package pilferage for small high-value items, such as consumer electronics.

BACKGROUND OF THE INVENTION

In the field of packaging, particularly in the field of healthcare and medication packaging and in the field of sleeve-and-drawer style packaging for a wide range of consumer goods, it is often required to provide consumers or patients with secure packaging that has child-resistant features to restrict or prevent access to the package contents by a child. At the same time, it is useful for the intended user to be able to access the products contained within the package with some degree of ease. As such it is beneficial if the packaging is also "senior-friendly". Many packages are available that comprise an inner slide card or drawer that holds articles in blisters or in trays. The inner slide card, with the articles, is then slidable inside an outer sleeve or outer shell. The inner slide card is usually retained and locked inside, the inner slide card by a locking flap that engages the outer sleeve. An unlocking mechanism is usually provided on the outer sleeve to permit the disengagement of the inner slide card from the outer sleeve. Such unlocking mechanisms often require some dexterity to operate or require user realisation that co-ordinated operation of more than one feature is required; this may make the package child-resistant. In some instances, this may also make the package less senior friendly than is desirable.

Further considerations in this technical field are the need for such packages to be reopened and relocked many times without failure. It is also desirable to keep the cost of the packaging as low as possible, whilst maintaining its durability. Whilst it is also advantageous to provide clearly printed information (such as pill calendars and/or other patient directed information) on the package, the size of the package is preferably minimised, not only to reduce its production costs by using less material, but also to reduce shipping costs. A light-weight and compact package, with a locking and unlocking feature that can withstand repeated use is therefore advantageous.

The present invention seeks to provide an improvement in the field of packaging, more specifically, but not exclusively, in the field of sleeve-and-drawer style packages.

SUMMARY OF THE INVENTION

According to an aspect of the invention for which protection is sought, there is provided a package comprising an outer container and an inner receptacle, the outer container forming a cavity for the inner receptacle having an access end, such as an open or openable end, through which the inner receptacle can be inserted and through which the inner receptacle can be withdrawn, the packaging comprising a two-part locking mechanism for locking the inner receptacle within the cavity of the outer container, the outer container comprising a first part of the two-part locking mechanism and the inner receptacle comprising a second part of the two-part locking mechanism, wherein the outer container comprises at least one demarcated pressing zone and wherein the at least one demarcated pressing zone is configured and/or stylised and/or shaped and/or arranged and/or decorated to encourage a user to apply a force directed inwardly of the outer container toward the cavity for deactivating the locking mechanism to thereby release the inner receptacle for withdrawal of the inner receptacle at least partially from the outer container.

Optionally, except for said open or openable end, each other external surface of the outer container is free of a full-depth cut.

Optionally, upon proper insertion of the inner receptacle within the cavity, the locking mechanism is automatically activated.

Further optionally, the package comprises two demarcated pressing zones, wherein a first of the two demarcated pressing zones is disposed on and/or within a first external face of the outer container and wherein the second of the two demarcated pressing zones is disposed on and/or within a second external face of the outer container and wherein the first and second external faces are spaced apart and disposed opposite to one another. Optionally a notional line between the first and second demarcated pressing zones is substantially orthogonal to a notional tubular axis extending through the outer sleeve.

Preferably, the demarcated pressing zone is for encouraging a user to apply a localised force and wherein the package is arranged such that a localised force applied in the region of the at least one pressing zone can cause disengagement of the locking mechanism.

Further preferably, the at least one demarcated pressing zone is: circular, irregular in shape, square, rectangular, triangular, oval, elliptical or rounded.

Optionally, the at least one demarcated pressing zone is printed with graphical indicia to highlight the region where a user of the package should apply a force.

Optionally, the outer container comprises a top wall and a bottom wall and wherein only one demarcated pressing zone is provided and the demarcated pressing zone is provided in the bottom wall.

Further optionally, the at least one demarcated pressing zone comprises a physical formation and wherein the physical formation is any one or more or a combination of: an embossment, a debossment, a groove, a compression, a half-depth cut, a raised button, a recessed button.

Additionally or alternatively, the at least one demarcated pressing zone does not overlap in super-position with a locking edge provided as the first part of the locking mechanism in the outer shell.

Optionally, the at least one demarcated pressing zone is positioned closer to a rear end of the outer container than the first part of the locking mechanism in the outer shell is.

Optionally, the at least one demarcated pressing zone is spaced from and does not overlap the first part of the locking mechanism provided in the outer shell.

Further optionally a centre of the demarcated pressing zone may correspond to a focal point for the desired force to be applied for effecting disengagement of the locking flap from its catch with the engaging edge According to another aspect of the invention for which protection is sought, there is provided a blank for forming an outer sleeve for use in a package according to any relevant preceding paragraph. Optionally, the blank comprises a series of hinged panels for forming outer top, bottom, inner top and side walls of the outer sleeve and wherein the at least one demarcated pressing zone is formed in the top and/or bottom panel and is offset from a notional line through the first part of the locking mechanism formed in an inner top panel of the blank toward the rear of the outer shell.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Embodiments of the invention will now be described, by way of example only and with reference to the following drawings.

DETAILED DESCRIPTION OF THE PREFERRED EMBODIMENTS

Figure 1:
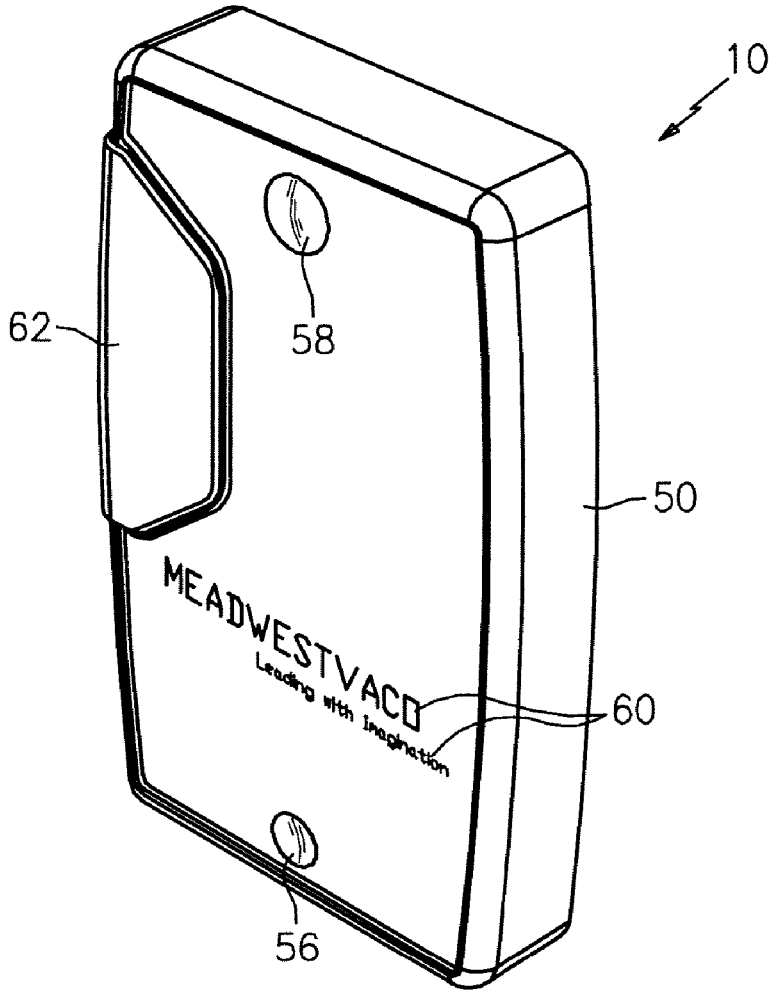
FIG. 1. is a perspective view of a branded package that is constructed in accordance with a first optional embodiment of the present invention.

Detailed descriptions of specific embodiments of the outer-shells, inner trays and cards packages, blanks and cartons are disclosed herein. It will be understood that the disclosed embodiments are merely examples of the way in which certain aspects of the invention can be implemented and do not represent an exhaustive list of all of the ways the invention may be embodied. Indeed, it will be understood that the outer-shells, inner trays and cards packages, blanks and cartons described herein may be embodied in various and alternative forms. The figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Reference is now made to the accompanying figures for the purpose of describing, in detail, preferred and exemplary embodiments of the present disclosure. The figures and detailed description are provided to describe and illustrate examples in which the disclosed container may be made and used, and are not intended to limit the scope thereof. Those skilled in the art will readily appreciate that the disclosed containers can be used to store a variety of products. More specifically, the disclosed containers can be used for the storage of products, such as for example, smokeless tobacco, cigarettes, confectionary, cigarettes, tea bags or any product stored in a pouch, mints, and the like without departing from the inventive aspects of the present disclosure.

Generally the present invention teaches the provision of method of unlocking a container or disengaging a locked inner receptacle from an outer-sleeve or outer container. According to a preferred aspect of the invention the externally facing walls or panels of the outer-sleeve or outer container are free from cut lines that in the prior art are used to define and form unlocking mechanisms or release mechanisms. As such the externally facing walls or panels of the outer-sleeves or outer-containers of the present invention are uninterrupted or smooth or in other words retain their structural integrity. This is advantageous because cut-lines and moveable release tabs that can move relative to the plane of an external wall or panel provide an entry point for the ingress of air, dust or dirt. Where product freshness is a consideration, ingress of air, dust and dirt is a problem. Furthermore cut out release tabs provided on external walls or panels can become damaged and sometimes deliberately so prior to purchase of the package. As such, cut release tabs can provide a point of weakness in the package which may enable a thief to access the package contents prior to purchase.

The present invention therefore provides containers or outer-sleeves having an alternative method for disengaging a lock between an outer-shell type container or other lockable container that specifically eliminates the requirement for a cut release tabs in the external walls or panels. Instead, aspects of the present invention provide a demarcated pressing zone which is physically formed and/or designed to illustrate to a user or consumer where on the package a user or consumer should press in order to effect unlocking of the container or disengagement of an inner receptacle from the outer container.

Figure 2:
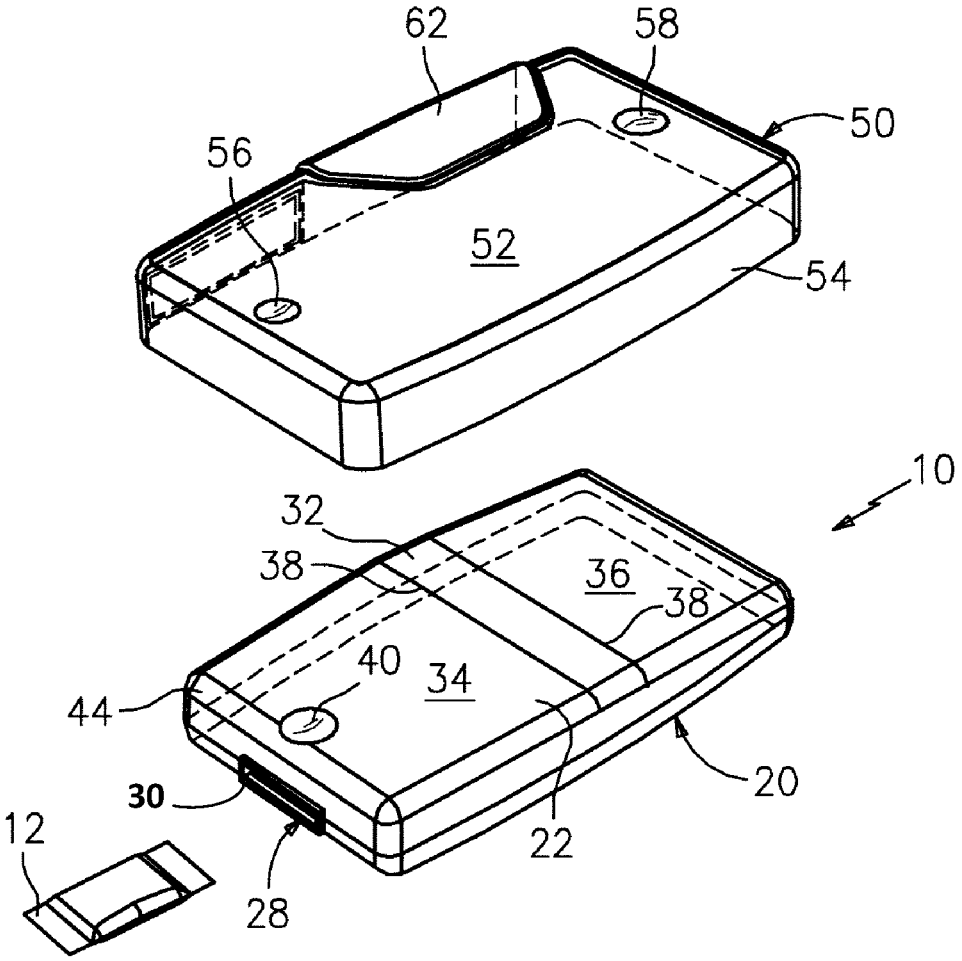
FIG. 2. is an exploded perspective view of the package of FIG. 1.
Figure 3:
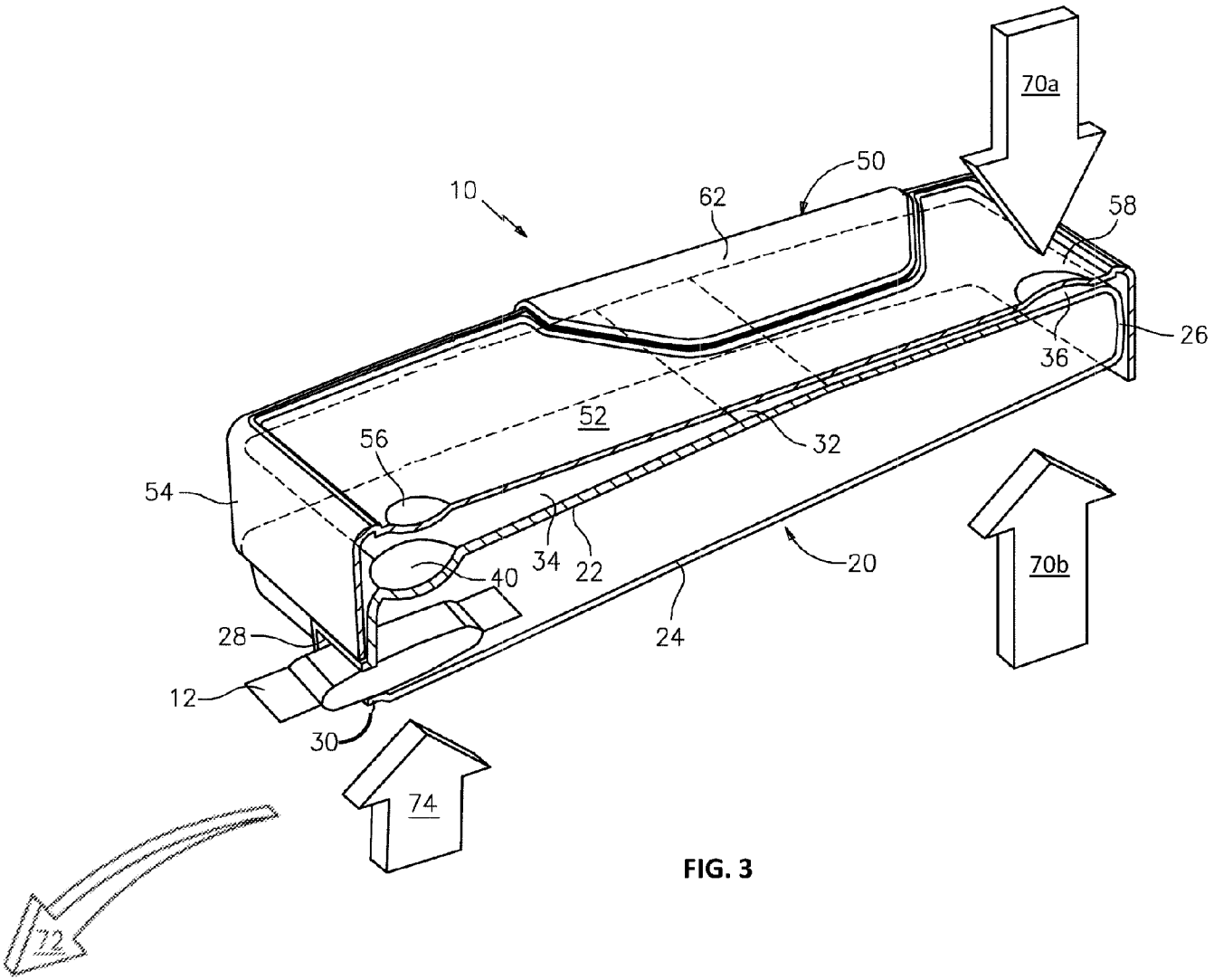
FIG. 3. is a perspective, sectional view of the package of FIG. 1, wherein the package is in the open position.

Referring now to FIGS. 1 through to 3, there is illustrated a package for storing a product, such as smokeless tobacco, which has been constructed in accordance with a first exemplary embodiment of the present invention and designated generally by reference numeral 10. The package 10 includes an inner container 20 and an outer cover 50. In FIGS. 2 and 3, many internal structural details of the package 10 are shown in phantom line for clarity.

As best viewed in FIG. 3, the inner container 20 of package 10 has opposing upper and lower surfaces 22, 24 and a sidewall 26 extending between the upper and lower surfaces 22, 24 to define an interior for storing a plurality of products 12. It will be readily appreciated that the inner container 20 and outer cover 50 of the package 10 can be formed as a monolithic structure or can be formed using two or more parts/elements without departing from the inventive aspects of the present disclosure. Additionally, the methods used to join the parts can vary and include, for example, fasteners, interlocking structures, welding and/or adhesives.

As shown herein, the inner container 20 of the package 10 is molded or formed as a single-piece unit. Typically, the inner container 20 of package 10 is made from a polymeric material, such as plastic, and is formed using a process, such as injection molding. The inner container 20 and package 10 may be formed from any other suitable material and from any suitable number of parts.

An opening 28 is provided in the sidewall of the inner container 20 of the package 10 through which product 12 housed within internal product storage compartment can be accessed or dispensed. The products 12 can be neatly packed or loosely packed to allow movement within the inner container 20. A flange 30 surrounds the opening 28 to provide a sealing surface for engaging the outer cover 50.

As best seen in FIG. 2, an upper surface 22 of the inner container 20 has an apex region 32 intermediate a first region 34 and a second region 36. The apex region 32 preferably forms a peak. In other words, the first and second regions 34, 36 are slanted away from the apex region 32 such that the upper surface 22 is not planar. In a preferred embodiment, the first region 34 is substantially parallel to the lower surface 24 (see FIG. 3) and only the second region 36 is slanted or angled relative to the lower surface 24 of the inner container 20. In one embodiment, the apex region 32 includes two raised ribs at the junction 38 between areas to facilitate opening and closing the package 10 as is described below.

The outer cover 50 holds the inner container 20 of package 10 and selectively seals the opening 28. The outer cover 50 includes an upper section 52 with a depending sidewall 54. The outer cover 50 is optionally provided with two pressing zones: a first in the form of a first finger recess 56 is formed above the first region 34 and facilitates closing of the package 10; and a second, in the form of a second finger protuberance 58 is formed above the second region 36 and facilitates opening of the package 10. The upper surface 22 of the inner container 20 optionally comprises an internal recess 40 corresponding to and co-operable with the first zone finger recess 56. Optionally the internal recess 40 is provided to prevent undesirable interference with the operation of the package 10.

The inner container 20 nests within the outer cover 50. In one embodiment, the outer cover 50 only has two pressing zones 56, 58 in the form of a recess 56 and protuberance 58 adjacent the apex region 32. In another embodiment, the outer may comprise a fewer or greater number of pressing zones and optionally any of them may be co-operable with a corresponding internal recess 40 or internal protuberance as is described below.

When nested, the apex region 32 contacts the outer cover 50 to form a rocking mechanism.

Referring to FIG. 3, to open the package 10, the user simply applies a downwardly focused force on or proximate the second pressing zone 58 to the package 10 at least substantially in the direction indicated by arrow 70 and a corresponding or lesser strength force at least sufficient to cause relative movement of the inner receptacle (inner container) 20 and outer container 10 at least substantially in the direction indicated by arrow 70*b*. The provision of a demarcated pressing zone in the form of a second finger protuberance 58 facilitates not only easy pinching but insures that the force is applied and focused in an appropriate location to efficiently cause the package 10 to open. The pinching force overcomes the forces holding the inner container 20 in the closed position and causes the package 10 to pivot open. In particular, the second region 36 of the inner container 20 moves or arcs towards the upper section 52 of the outer cover 50 and the first region 34 moves away or arcs away from the upper section 52 along arrow 72. As a result, the opening 28 slides past the sidewall 54 of the outer cover 50 so that a product 12 can be accessed or dispensed. In the open position, the second region 36 is flush against the upper section 52 and the opening 28 is below the sidewall 54 and the product 12 can be dispensed.

To dispense the product 12 once open, the user taps or shakes the package 10. For pouch products as shown, the pouch product 12 may be partially exposed and, if not desired, pushed backed into the package 10.

To close the package 10, a user simply applies pressure to the inner container 20 of the package 10 along arrow 74. The first pressing zone provided by first finger recess 56 facilitates easy pinching and insures that the force applied by the user is concentrated in an appropriate point or region to efficiently cause the package 10 to close. The pinching force causes the package 10 to pivot closed. In particular, the first region 34 of the inner container 20 moves or arcs toward the upper section 52 of the outer cover 50 until contact between the two occurs. At the same time, the second region 36 moves away or arcs away from the upper section 52. As a result, the opening 28 slides into the sidewall 54 of the outer cover 50 so that the opening 28 becomes resealed.

In addition to the advantages noted above, the disclosed packages provide a novel experience for users when consuming products such as, for example, smokeless tobacco. Moreover, the construction and operation of the cover allows the graphic present on the top surface to be visible at all times during opening and closing of the packages.

The container 10 may be produced from a recycled material such as PET. The container 10 may be formed from recycled material and may be further recycled when the package is no longer of use to the consumer. The container 10 may be formed from a material that allows the structure to be flexible and/or semi ridged. Preferably the structure is light weight and having one or more thin walls compared to an injection molded equivalent container.

Referring now to FIGS. 4-17, further embodiments of the present invention are illustrated. In the second and third and subsequent illustrated embodiments, like numerals have in some examples, been used to denote like parts, albeit with the addition of the prefix "100" or "200" and so on to indicate that these features belong to the second embodiment, third embodiment and so on. The further embodiments share many common features with the first embodiment and therefore only the differences from the embodiment illustrated in FIGS. 1 to 3 will be described in any greater detail.

Figure 4:
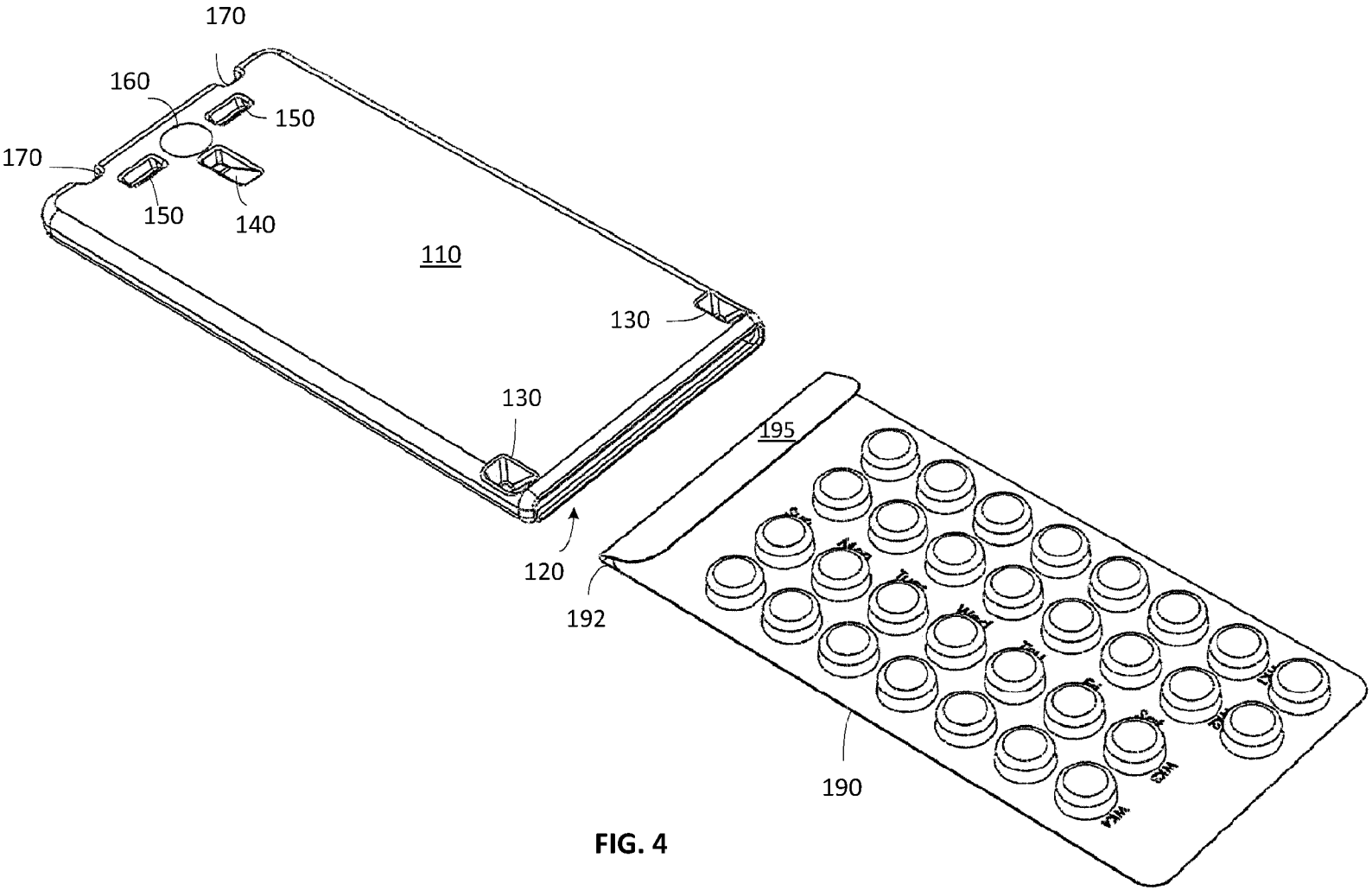
FIG. 4. is a perspective top view of an outer-shell container and an insert card according to a second embodiment of the invention.

Referring now to FIG. 4, there is shown an outer container 110 or outer sleeve 110 configured to house and retain an inner receptacle (also referred to as insert card) 190. FIG. 4, shows a perspective top view of the container 110 (optionally of a construction that is generally flat and rectangular) defining an interior chamber accessible by an opening 120 at one end of the container 110. (It is to be understood that one or more opening(s) may be positioned at opening 120.) There are multiple elements that assist in the insertion and retention of an insert card 190. In this view showing the top surface of the container 110, a pair of retaining elements 130 are shown positioned near the opening 120 and serve to prevent an insert card 190 from being completely removed once it has been inserted into the container 110. It is to be understood that one or more retaining element(s) 130 may be used.

Also shown (from the outside) is a locking stop element 140 that is positioned toward the closed end of the container 110 and is generally centered with respect to the width of the container 110. It is to be understood that one or more locking stop elements 140 may be used. It is to be further understood that the locking stop elements 140 may be located to the sides of the package should manufacturing preferences require. The locking stop element 140 may slope inward and away from an access end, such as the open end 120, before returning to the top surface at a substantially perpendicular angle. It is to be understood that the locking stop element 140 may be adjusted based on manufacturing preferences.

A pair of locking guides 150 may assist in positioning an insert card 190 within the interior chamber of the container 110 and are described in more detail below. It is to be understood that one or more locking guide(s) 150 may be used in a container 110 according to other envisaged embodiments.

A pair of insert card stops 170 are optionally provided to assist in defining the position of the insert card 190 when fully inserted and secured in place within the cavity of the outer shell container 110. It is to be understood that one or more insert card stop(s) 170 may be used. Unlocking of the insert card 190 preferably is achieved by a user applying a force in a pressing zone 60 that flexes a locking area of the outer container 110 inwardly of the container cavity. The inward motion or inwardly disposed state of the unlocking element or release element of the outer container 110 deflects an element 195 of the insert card 190 past a locking feature 150 present within the container 110. With the pressing zone 160 depressed into an unlocking or deflected state, the insert card 190 can be gripped and withdrawn from the outer sleeve 110. It is to be understood that a package according to optional variations of the presently described embodiment may be designed to open by applying a force to the sides and/or bottom and/or top of the package or any suitable combination. One or more pressing zones 160 demarcating an area for a user to either hold or press maybe provided. It is to be understood that the package may be designed such that other areas of pressure or any combination of these areas may be used to open the package and that the design of such package may be based on manufacturing preferences.

The container 110 (also referred to as outer sleeve 110) comprises one or more pressing zones 160 also referred to a locking release buttons 160 provided to assist in and unlocking a slide card 190 when disposed and locked with the container 110 by encouraging a user to apply a sufficient downward force. It is to be understood that one or more release buttons 160 may be used in other envisaged embodiments.

Figure 4A:
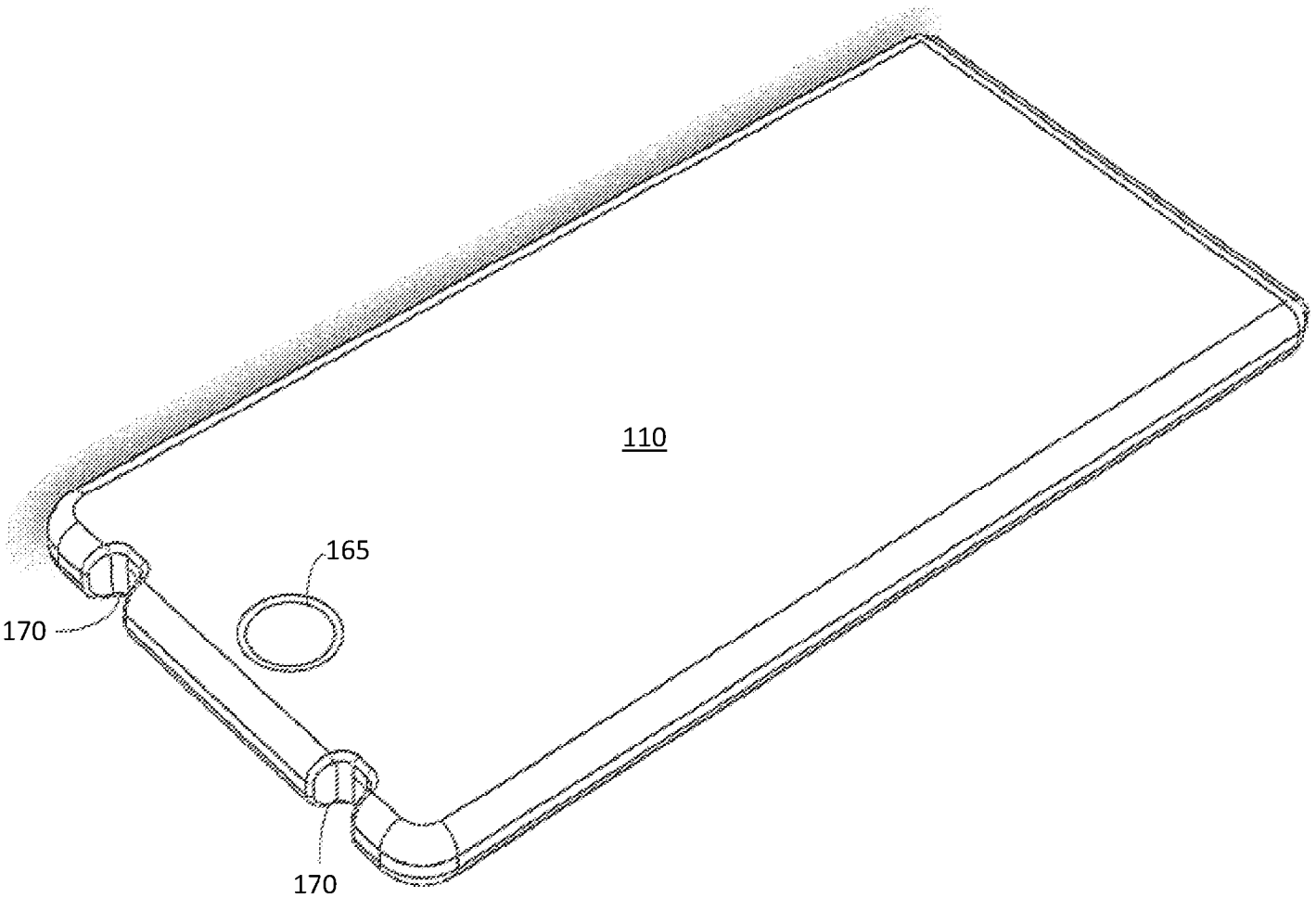
FIG. 4A. is a perspective bottom view of the outer-shell container of FIG. 4.

FIG. 4A is a perspective bottom view of the outer shell container 110. The view of FIG. 4A shows the bottom surface of the container 110. A second pressing zone 165, also referred to as an indent support platform 165 is shown that generally corresponds with and is super positioned below the locking release button 160 provided on the top surface. The locking release buttons 160 165 can be pushed toward the interior of the container 110 to help disengage the insert card 190 from the locking elements 140.

Figure 5:
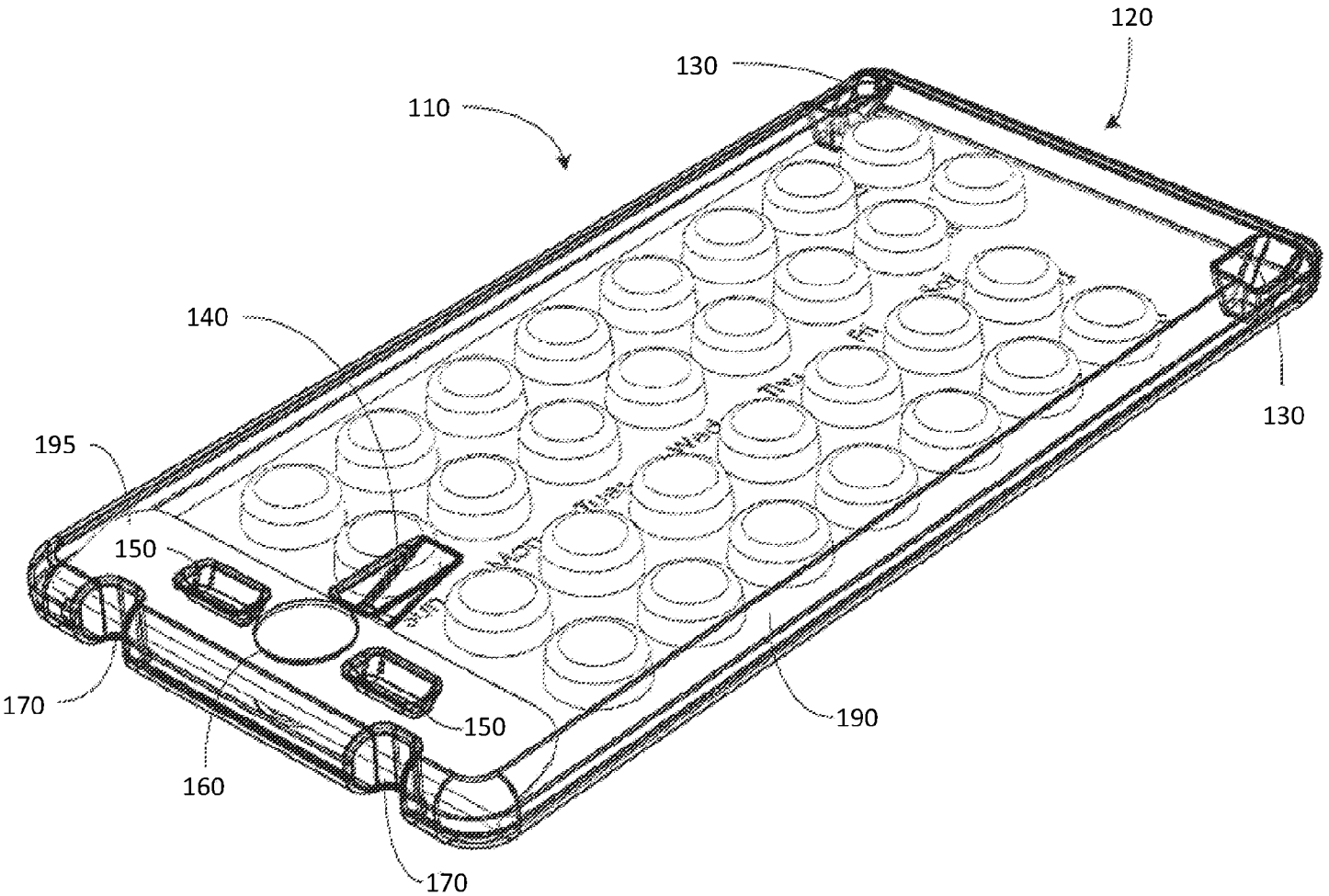
FIG. 5. is a further perspective top view of the outer-shell container depicted in FIG. 4 showing the insert card fully inserted into the container.

FIG. 5 is a perspective top view of the container 110 and insert card 190 according to the presently described embodiment of the invention. The insert card 190 includes an insert card flap 195 (also referred to as a locking tail flap 195) that is a folded portion on a rear end edge of the insert card 190. To prevent the locking tail flap 195 from being folded completely atop the insert card 190 there may be an insert card bump (also referred to as stopper) 192 that may limit the extent to which the insert card locking tail flap 195 can be folded back over toward the insert card 190. It is to be understood that one or more insert card locking tail flaps and one or more insert card stoppers (bumps) 192 may be used. It further is to be understood that a stopper (bump) 192 on the outside of the insert card locking tail flap 195 facing towards the container 110 rather than facing the blister when the locking tail flap 195 is in a folded position may interact with the locking element 140 of the container 110 itself. This may eliminate the risk of the locking tail flap 195 folding too close to the body of the blister and may help retain the insert card 190 in a proper alignment with respect to the various locking and unlocking 140, 160 components of the container 110.

FIG. 5 further shows the fold connection between the insert card 190 and the locking tail flap 195 abutting the insert card stops 170. The locking tail flap 195 may further be positioned in place by locking guides 150 which prevent the locking tail flap 195 from riding too high within the interior chamber of the container 110. The exposed edge of locking tail flap 195 abuts the locking stop element 140 in the locked position to prevent the insert card 190 from being removed from the container 110. To withdraw of the insert card 190 from the outer shell 110, manipulation of the locking/unlocking elements 140, 160, 165 is necessary.

Figure 6:
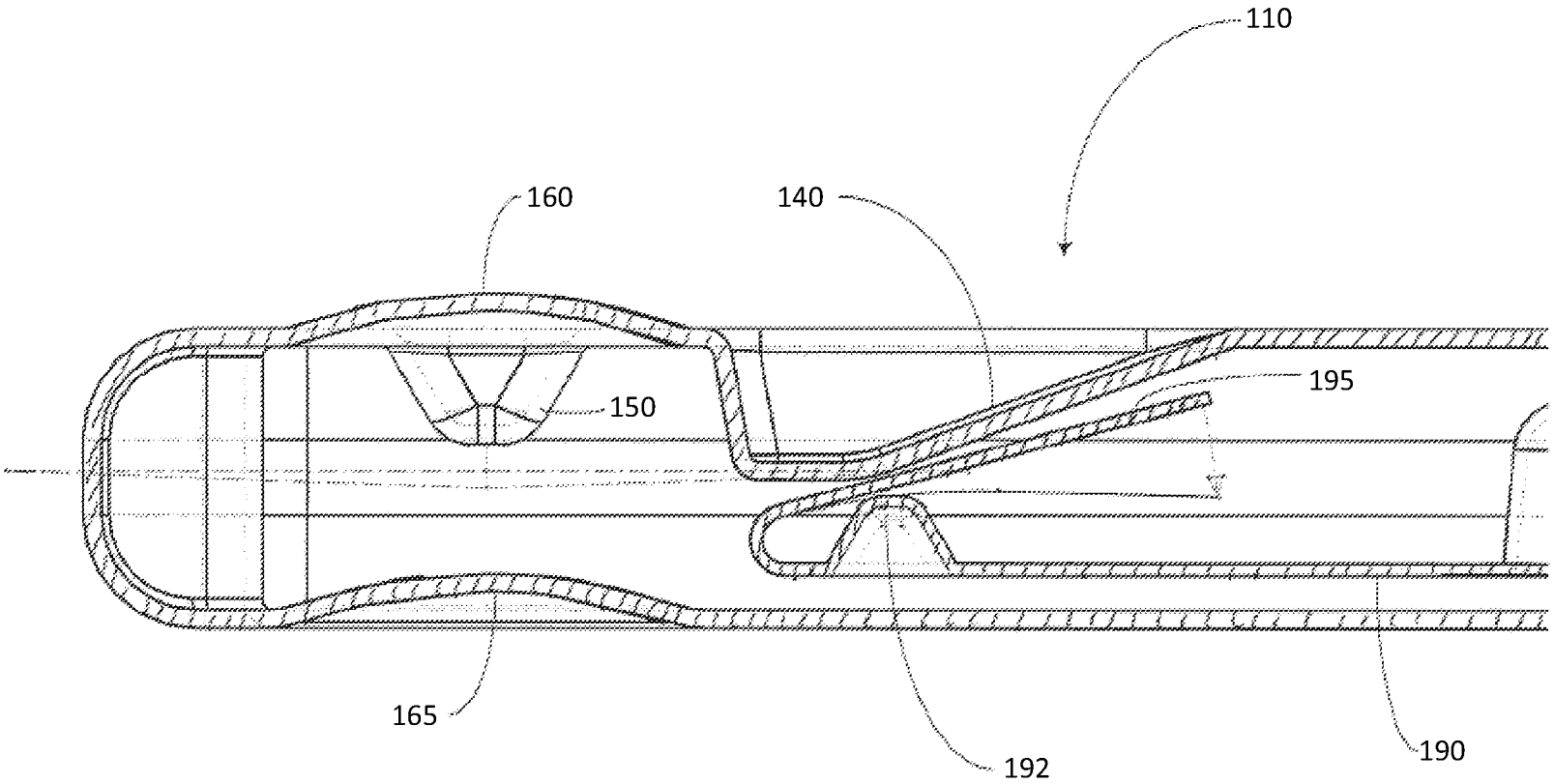
FIG. 6. is a cross-sectional view showing the interior of the outer-shell container of FIGS. 4 to 5 with the insert card not fully inserted therein.

In FIG. 6 a cross-sectional view showing the interior of the container 110 with the insert card 190 almost fully inserted therein is shown. This illustration is a snapshot of the insert card 190 immediately prior to the insert card 190 being located in a locked position within the container 110. The rear end edge of the insert card 190 includes the folded over locking tail flap 195. As this section approaches the downward and rearward sloping locking stop element 140, the locking tail flap 195 will deform as it slides past the lowest point of the locking stop element 140 creating a pivot point atop the insert card stopper (bump) 192. There is sufficient clearance between the insert card stopper (bump) 192 and the lowest point of the locking stop element 140 to allow the rest of the insert card flap 195 to pass through.

Figure 7:
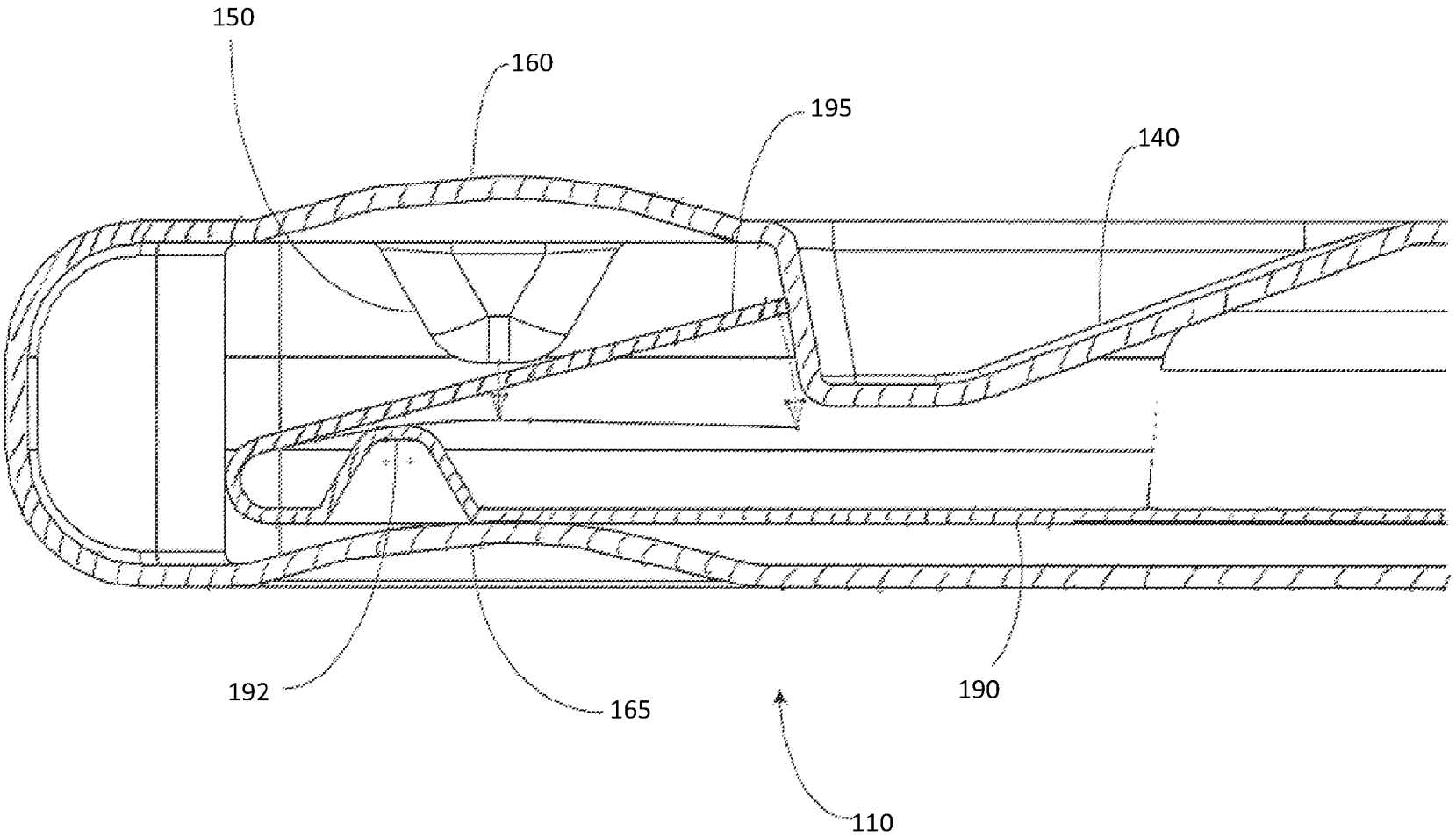
FIG. 7. is a cross-sectional view showing the interior of the outer-shell container of FIGS. 4 to 6 with the insert card fully inserted therein.

FIG. 7 is a further cross-sectional view this time showing the interior of the container 110 with the insert card 190 fully inserted therein. This illustration shows the insert card 190 in a locked configuration. The rear end edge of the insert card 190 abuts the insert card stops 170 preventing the insert card 190 from further advancing within the interior chamber of the container 110. Due to the natural resilience of the material from which the insert card 190 is formed, the locking tail flap 195 has rebounded at least slightly from the deflected position that was required to clear the lowest point of the locking stop element 140. The locking tail flap 195 is now held in place with the assistance of an indent support platform 165 (which elevates the rear end of the insert card 195 to ensure proper abutment of locking tail flap 195 and engaging element 140.); the locking guides 150; and the rear wall of the locking stop element 140. The insert card 190 is partially seated upon indent support platform 165 and cannot be removed from the container 110 without a user applying a force to the pressing zone 160.

To unlock the insert card 190 so that it can be withdrawn from the container 110, a downward force is applied to a demarcated pressing zone, in the form of locking release button 160. This action will cause the inward deflection of locking guides 150. When a sufficient force has been applied, the locking tail flap 195 will have been deflected such that its exposed edge will be below the level of the lowest point of the locking stop element 140. At this point, the user can grip the opposite trailing edge of the insert card 190 that is accessible via opening 120 and withdraw the insert card 190 from the container 110. Since the locking tail flap 195 is below the lowest point of the locking stop element 140 it will slide past the locking stop element 140 and can continue to be withdrawn until it encounters the retaining elements 130. It is to be understood that other methods/means of locking and releasing the inner card or tray may be used. Manufacturing preferences may dictate the best way to form the locking and releasing elements on the container and on the insert card to create a locking and releasing interaction between the two.

Optionally, the demarcated pressing zone, in the form of a locking release button 160 may be concavely curved, and rounded. Optionally however, other structures, methods and designs may be used to denote an area to encourage a user to squeeze the container 110 or otherwise apply a localized and inwardly focused force for unlocking the inner card 190 from its engagement with locking stop element 140. (In such a case, it may be beneficial to have the indent support platform 165 (also referred to a nesting area) formed in a complementary arch such that multiple packages may be stacked upon one another.) It is also to be understood that locking release button 160 may lay flat along the top surface of the container 110. In such a package, nesting area 165 may also be flat.

In further envisaged embodiments, the support platform 165 is not required. The interaction between insert card bump 192 and locking guide 150 when locking release button 160 is pressed by the user allows the locking tail flap 195 to arch such that the front end (toward the open end of container 110) of the locking tail flap 195 bends more quickly than the back end. This allows the front end of the locking tail flap 195 to clear the locking stop element 140 more quickly and allows for easier access to the insert card 190. The locking tail flap 195 may contact the locking stop element 140 at about a 90 degree angle when the insert card 190 is in the locked position. The front portion (towards the opening 120 of container 110) of locking stop element 140 may be angled on the side towards the open end of container 110 such that the insert card 190 may be slid into the package with little to no interference. The end portion of locking stop element 140 may be angled such that it forms a 90 degree angle or close to a 90 degree angle with the locking tail flap 195. It is understood that locking stop element 140 may have one or more additional segments.

Figure 8:
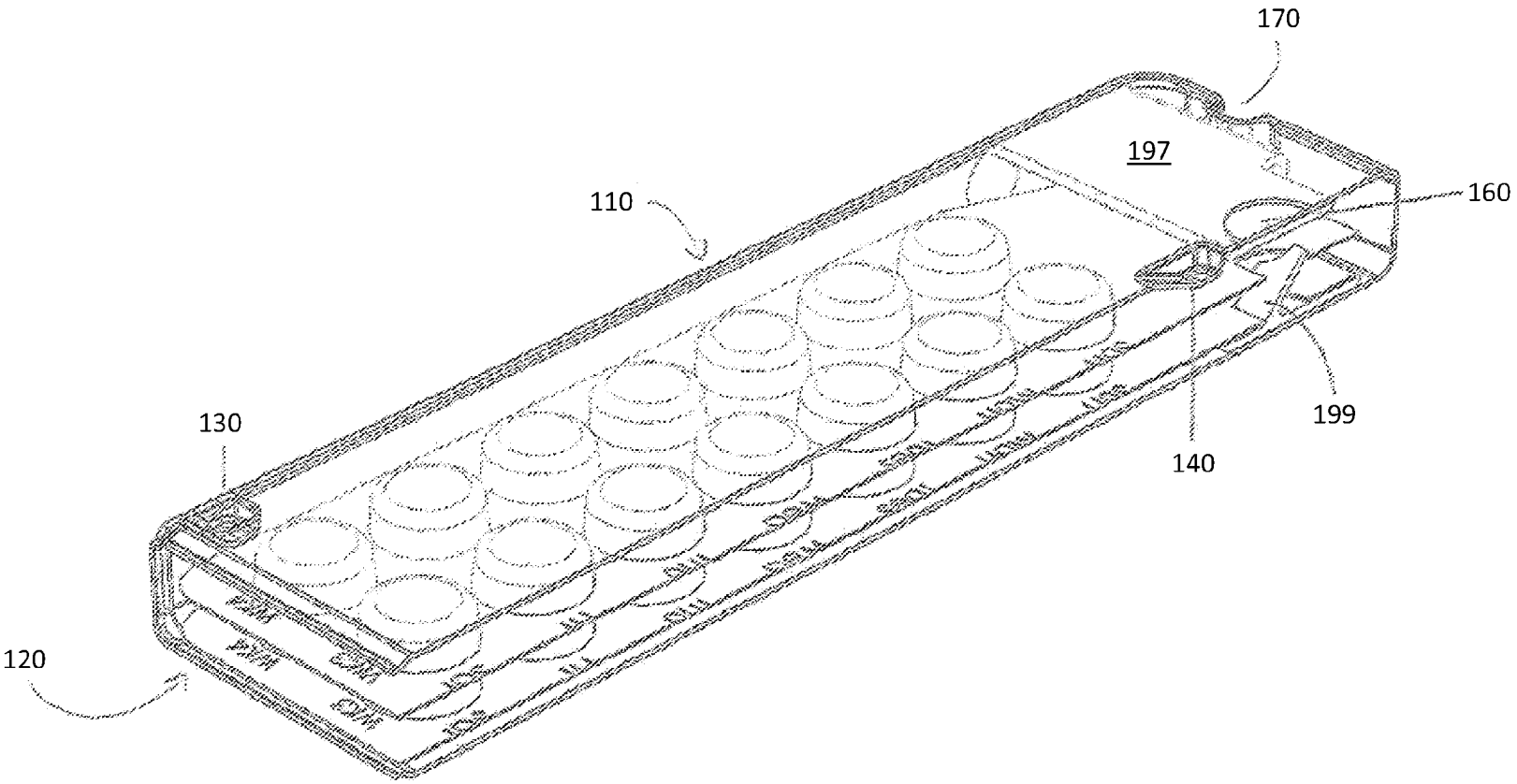
FIG. 8. is a perspective view partially cutaway, showing the interior housing of the outer-shell container of FIG. 4 and retaining two insert cards.
Figure 9:
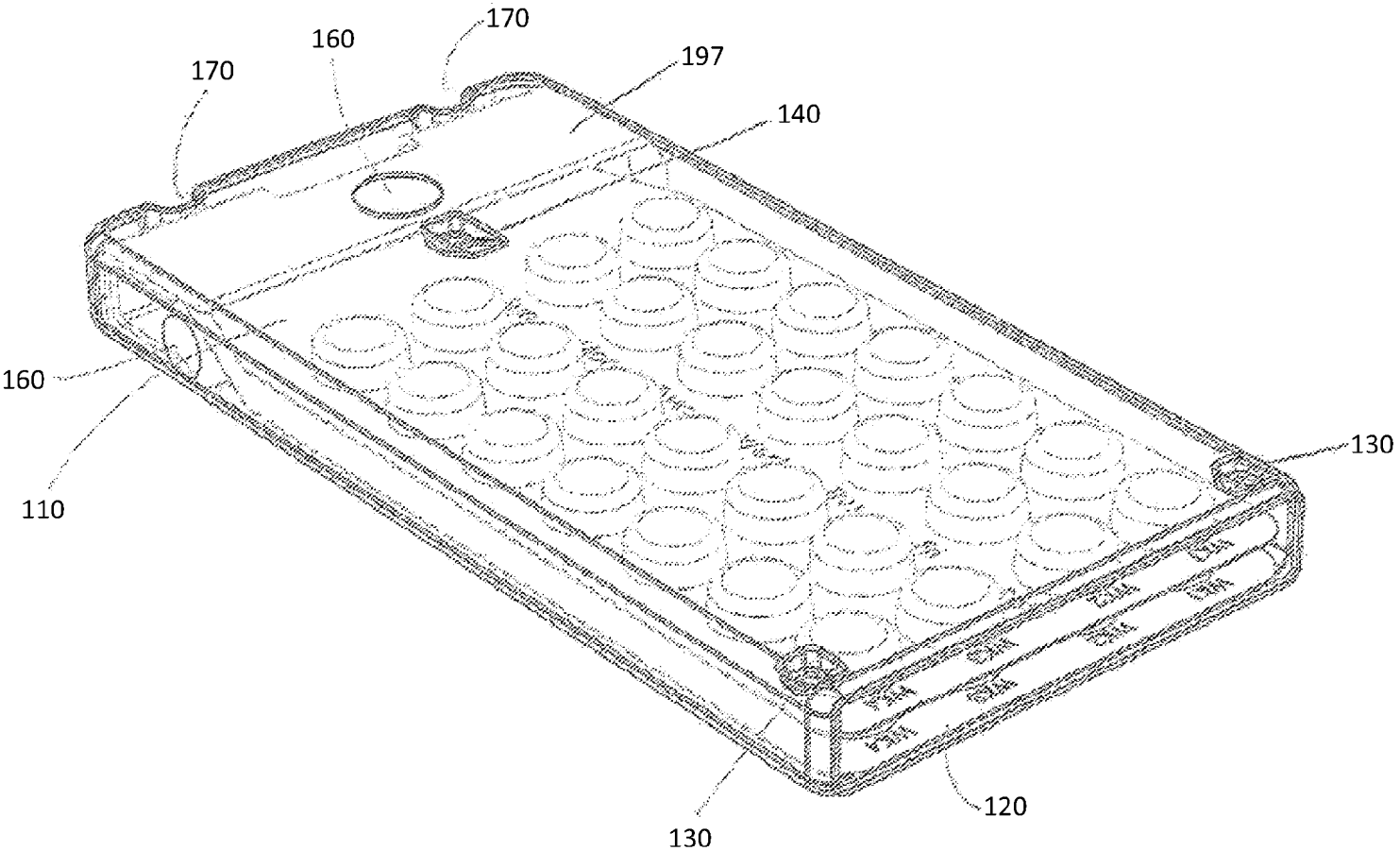
FIG. 9. is a perspective front view of the container of FIG. 8 using a traveler mechanism to hold the two insert cards.

It will be understood that multiple insert cards may be contained within any suitable container herein described with specific reference to container 110, FIGS. 8 and 9 show examples of a multi-blister pack being housed therein. It uses a plastic insert 197 (also referred to as a traveler mechanism) able to hold multiple blister cards as disclosed in U.S. Pat. Application Nos. 61/120929 and 61/287960 incorporated by reference herein. A traveler mechanism 197 is coupled to the plurality of insert blister cards and adapted to fit within container 110 in a lockable slidable fashion. The traveler mechanism 197 securely retains the plurality of insert blister cards. The container 110 may further include a thumb/finger indent at the open end front edge to assist a user when grasping an insert blister card housed within container 110. The traveler mechanism 197 is comprised of top and bottom portions that may be snap-fitted (or glued, or otherwise adhered) together such that when fit together, the traveler mechanism 197 may be seated within the interior chamber of the container 110 in a lockable and slidable fashion. The traveler 197 may be a single piece structure formed from a formable material, plastic fiber, metal, clay and or paperboard. It may be machine made or molded by injection, blow molded or formed by other methods. The traveler mechanism 197 may have a dagger 199 to hold a plurality of insert cards. The traveler mechanism 197 further comprises one or more flexible release tab(s) 160 that include a release tab stop 140 on at least one of the top and bottom portions of the container 110 such that the release tab stop 140 will abut the elongated tapered stop in a locked position that prevents the traveler mechanism 197 from sliding outward. It is to be understood that this locking element 140 may extend outside of the package. The traveler mechanism 197 further comprises a flat surface adapted to engage the at least one traveler stop 130 to prevent the traveler mechanism 197 from being completely withdrawn from within the interior chamber of the container 110 and at least one post adapted to fit within the at least one aperture of the plurality of primary packages. Directional channels may be formed along the side edges of the interior of container 110 such that the side edges of the traveler may glide along these level changed areas. It is to be understood that the seamless structure of the single piece container may not require the use of these directional channels. One or more release button(s) 160 may be provided on the top, bottom or sides of the container 110. It is to be understood that the location of the release button 160 (also referred t as a demarcated pressing zone) will be determined based on manufacturing preferences and the locking mechanism 140 chosen. For some formats a side squeeze opening feature will be appropriate and for others a top and or bottom opening feature is more effective.

Figure 10:
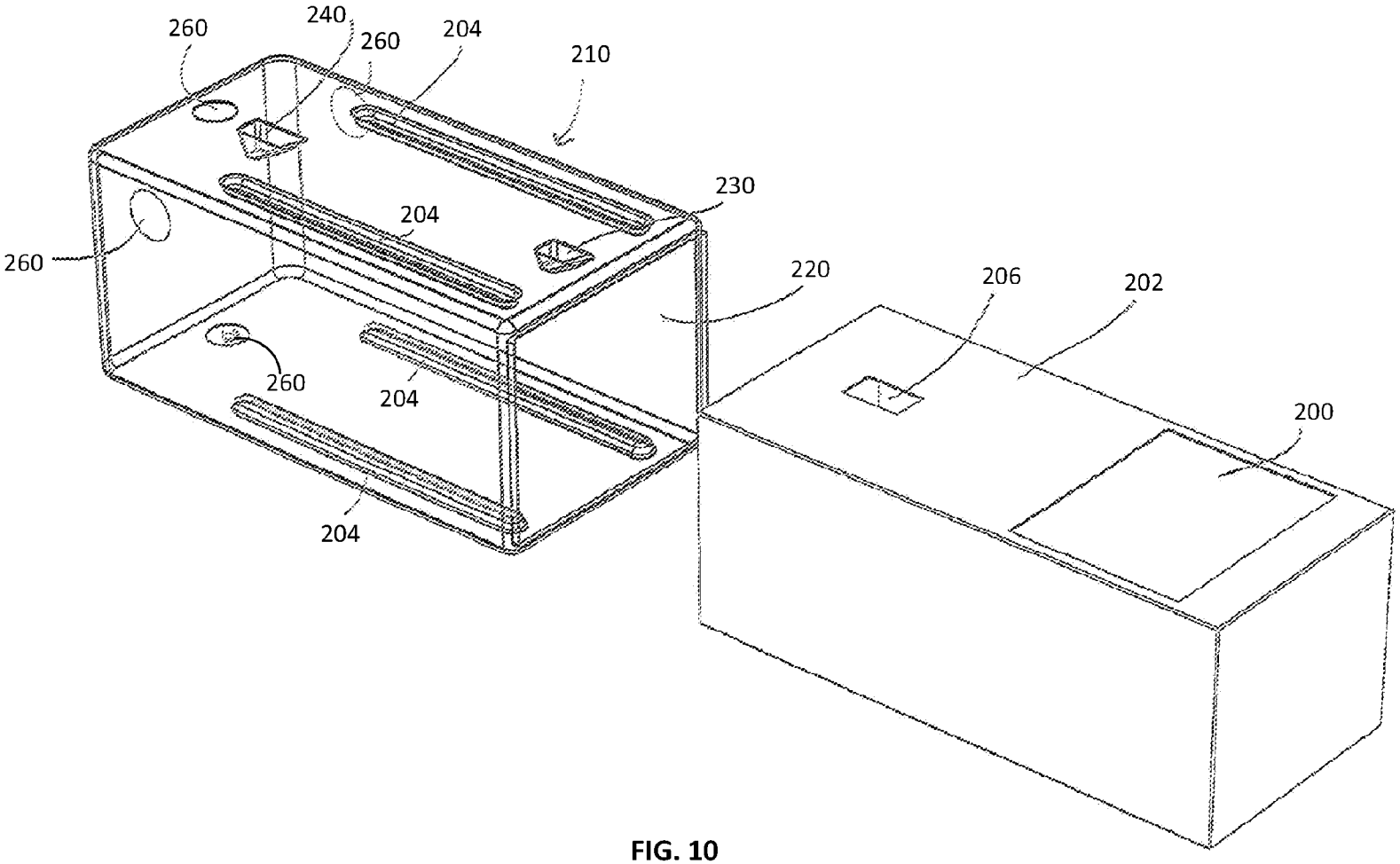
FIG. 10. is a perspective side view of an alternate embodiment using a slidable tray in place of an insert card.
Figure 11:
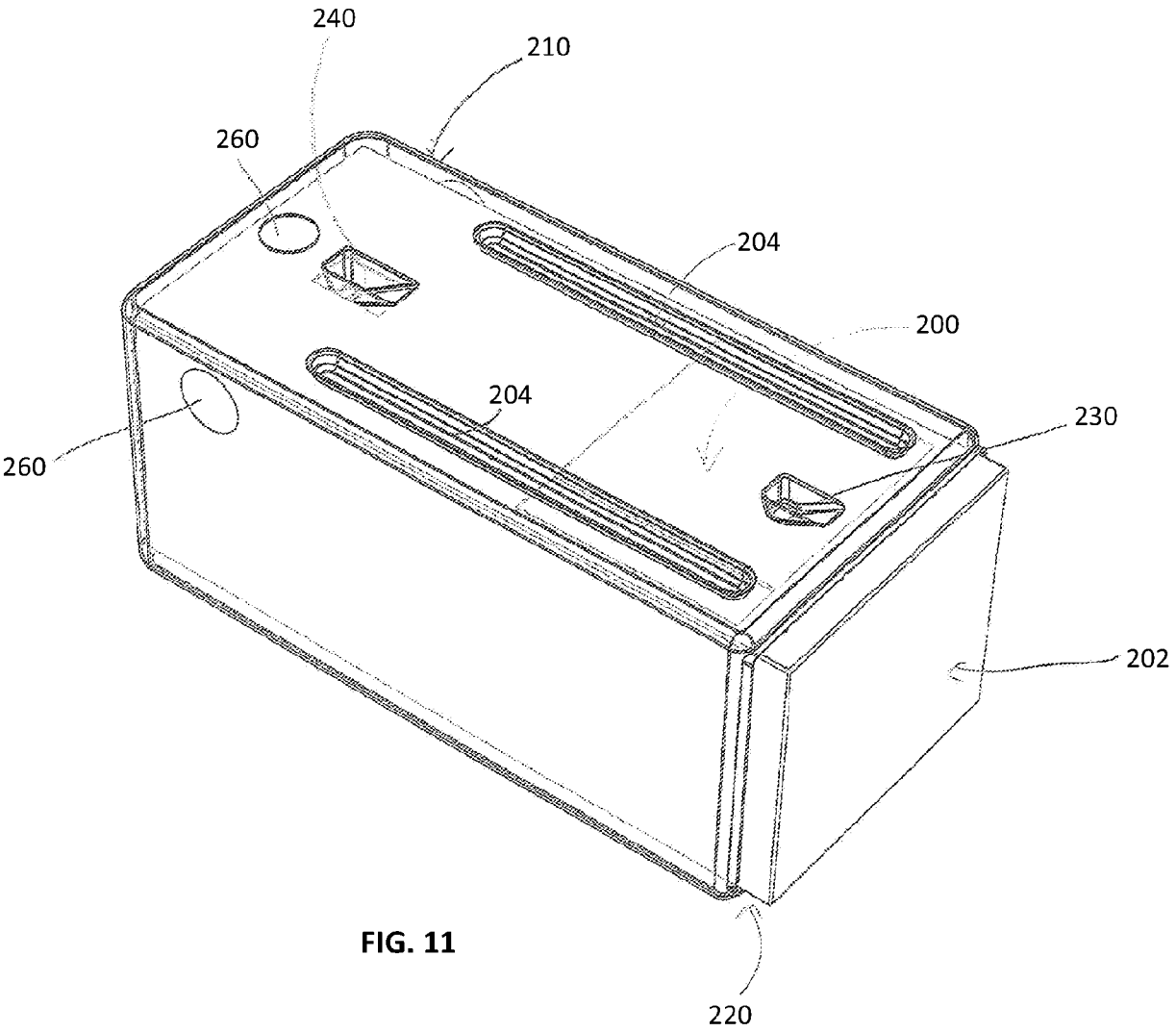
FIG. 11. is a perspective side view of the container of FIG. 10, showing an almost closed condition of that container.
Figure 12:
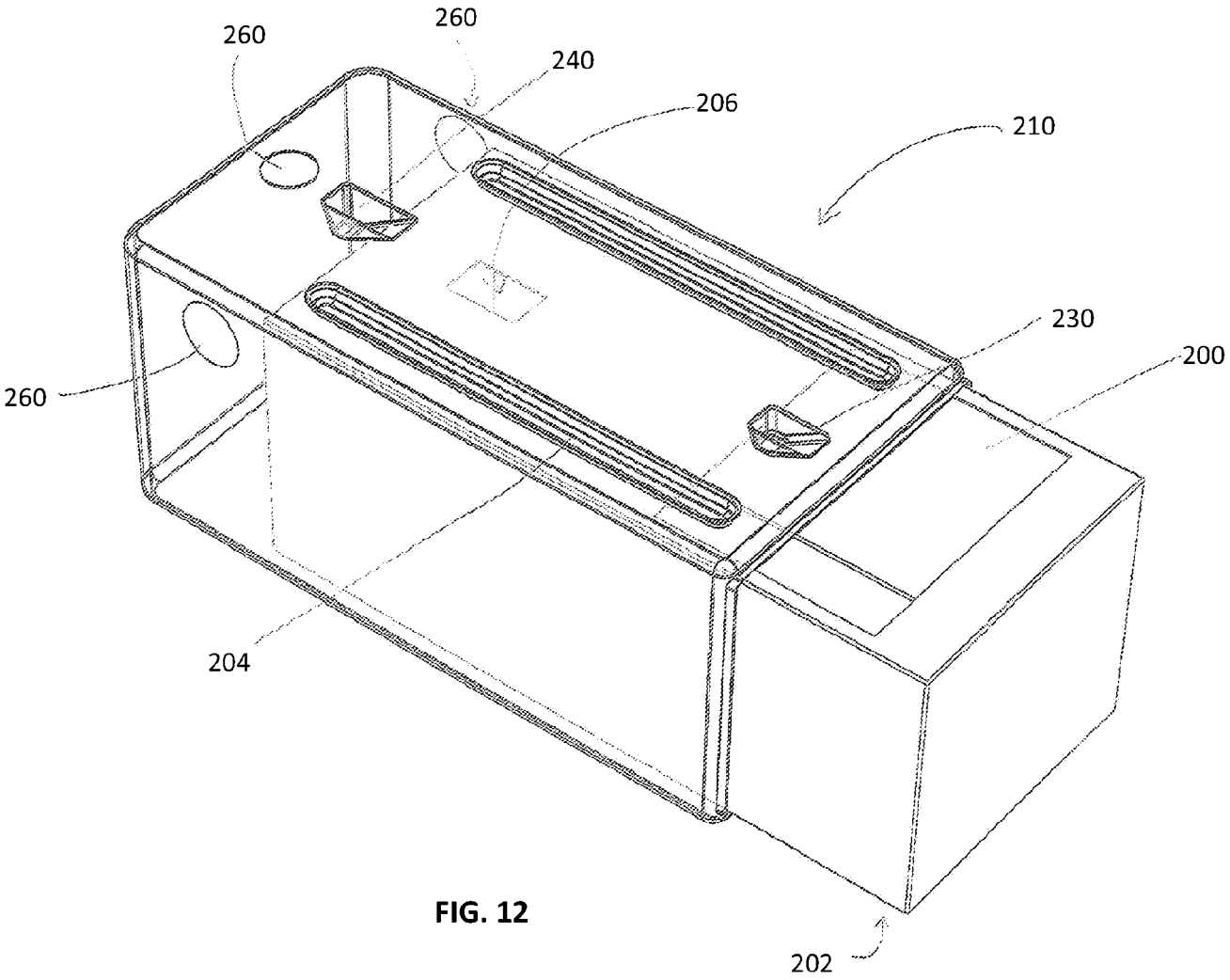
FIG. 12. is a perspective view similar to FIG. 11.

FIGS. 10-12 disclose a container 210 for holding a slidable tray 202. The slidable tray 202 may have one or more openings 200 to allow the user to access a product. The product may be a loose fill product such as mints, gum, cigarettes, pills, band aids, syringes, topical treatments or any other products. The inside of slidable tray 202 may be lined with water resistant material or other such barrier materials. The inner tray 202 may be a blow molded structure, plastic, paperboard or other types of material. The product may be in the form of pouches of medication as well, such as travel packs. One or more channels 204 may be added to container 210 to keep the inner tray 202 from moving while it is in the closed position. It is to be understood that these channels 204 may improve the ability of locking element 240 to interact with opening 206. The rear end edge of opening 206 may maintain an almost 90 degree angle with the axis of projection of locking element or projection 240. In this particular embodiment, the rear end of the projection 240 provides a locking edge that engages and cooperates with the rear end edge of the opening 206. It is to be understood that opening 200 may be covered by a re-sealable material such that it rolls back as the package is removed and re-seals as the package is returned to the locking position. Such material may have barrier properties. It is to be understood that opening 200 may be covered by paperboard with perforations around the opening area such that the user may remove the paperboard of other such material to access the product. A lip may be formed around the opening 220 of the container 210 such that opening 220 may be smaller than the interior cavity of container 210. This feature may assist with the effectiveness of the locking and retention features as well as child resistance.

Furthermore it can be seen that a pressing zone 260a, 260b is demarcated in each of top, side and bottom walls of the outer container 210. In use the four pressing zones 260*a*, 260*b* provide two sets of opposite and co-operative pressing zone pairs 260*a*; 260*b* a first pair formed in the side walls 260*a*, and a second pair 260*b* formed in the top and bottom wall. Localized inward depression of outer container 210 by a user applying a force (optionally by squeezing the outer container between a thumb and forefinger in the proximity of a pair of pressing zones 260*a*, 260*b* can affect the release of the inner slideable tray 202. This is because the squeezing force applied by a user to the outer carton is transferred to the slideable tray 202 which in turn is similarly distorted. The squeezing force may cause the wall or panel of the slideable tray 202 comprising a locking aperture 206 to blow, buckle or otherwise suitably distort to cause the locking aperture 206 to move out of engagement with the locking projection 240. In this way, specific locations have been highlighted to the user as suitable for being inwardly depressed to affect unlocking of the locking tray 202.

Figure 13A:
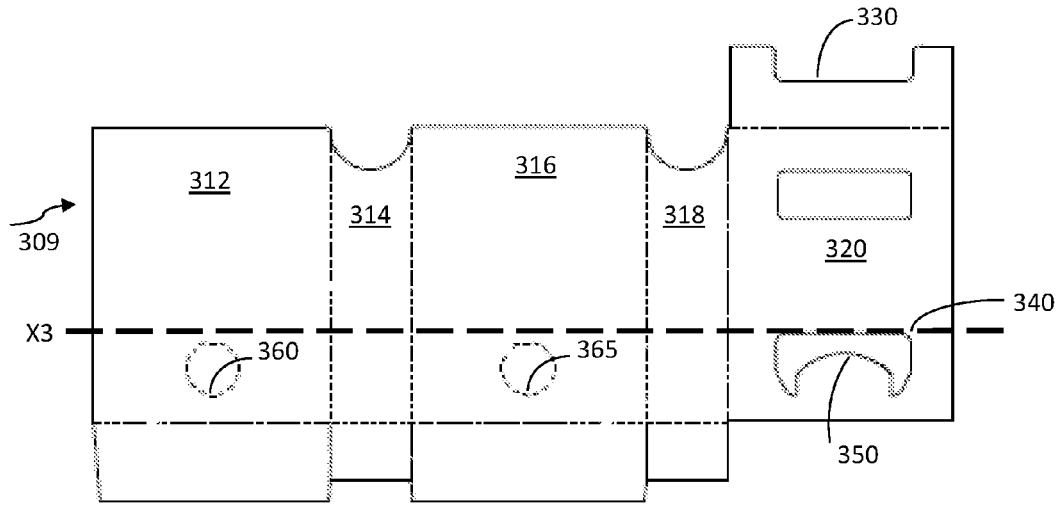
FIG. 13A. is a plan view of a blank of foldable sheet material for forming an outer-shell type container according to a fourth embodiment.
Figure 13B:
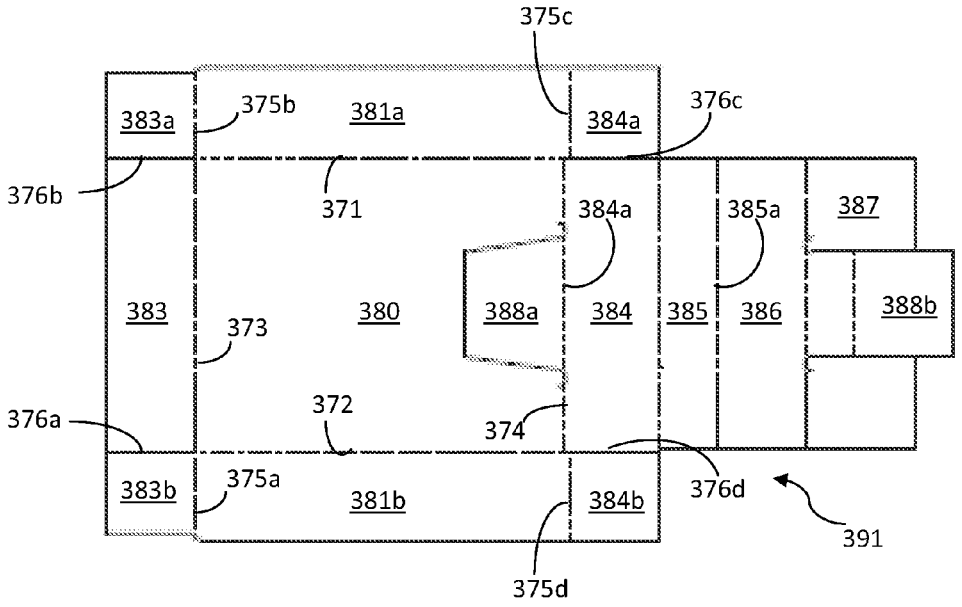
FIG. 13B. is a plan view of a blank of foldable sheet material cut, creased and arranged for forming an inner-tray or drawer according to another embodiment of the invention.

A package according to a fourth embodiment of the invention will now be described with reference to FIGS. 13A and 13B. In FIGS. 13A and 13B blanks 309, 391 are provided; each blank may be formed from any suitable foldable sheet material. In the presently illustrated arrangement, the blanks 309, 291 are each formed from paperboard optionally having at least one coated and printed side. Blank 309 is for forming an outer shell 310 (see FIGS. 15A and 15B) and blank 391 is for forming an inner receptacle in the form of a tray (not shown in constructed form). Optionally the tray formed from the blank 391 is suitable for holding articles such as chewing gum.

Referring to blank 309 for forming an outer shell, an outer bottom panel 312 is provided with a first demarcated pressing zone 360; a pair of side panels 314, 318 hingedly connect an outer top panel 316 to the outer bottom panel 312 and to an inner bottom panel 320. A second demarcated pressing zone 365 is provided in the top panel 316. A locking aperture is provided in the inner bottom panel 320 for catching or engaging a locking element of the inner receptacle. A flexing release tab 350 is formed adjacent the locking edge 340 of the locking aperture, the tab 350 is depressible to disengage a locking element of an inner receptacle from engagement with the locking edge 340. A stopper flap once folded and optionally adhered to an internal face of the inner bottom panel 320 provides an edge 330 against which an inner receptacle is caught to prevent or restrict the inner receptacle form being completely withdrawn from the outer sleeve.

Optionally, each demarcated pressing zone 360, 365 is circular in shape. Further optionally, the two demarcated pressing zones 360, 365 are similarly sized, have a similar radius and are positioned such that in the outer shell 310 formed from the blank 309, the demarcated pressing zones 360, 365, are in super positioned, vertical spaced alignment. Further optionally, each demarcated pressing zone 360, 365 is formed by a circular depression made in the material from which the blank 309 is formed. Optionally this may be pressed into the material. Optionally the depression may be formed by compressing a circular shape into the material, may be embossed, debossed or optionally scored, creased or partially cut (for example by a half-depth cut or series of interrupted nick cuts and creases). Preferably, the demarcated zones 360, 365 are not formed by cutting completely through the material in order to avoid creating an entry point for the ingress of dirt and dusts and air. Preferably, graphical indicia may cover the demarcated pressing zone. Further optionally, graphical indicia may be provided. Reference is made to FIGS. 15A and 15B which show an outer shell 310 made from a blank 309 that has been printed with graphics "G" that are not shown on the blank 309 in FIG. 14A. Specifically, it can be seen in FIG. 15A that the outer bottom panel 312 is printed with colours, shapes and lettering and the demarcated pressing zone 360 is partly disguised by the graphics "G", i.e., the "S" logo, whereas the demarcated pressing zone 365 formed in the outer top panel 316 is printed in a plain background and slightly more prominently visible. As shown in FIG. 15A, the demarcated pressing zone 360 is generally located between the rear end wall 332 of the outer shell 310 and the locking edge 340 of the inner bottom panel 320. More particularly, the pressing zone 360 is in substantial alignment, and in face-contacting relationship, with the flexing release tab 350 of the inner bottom panel 320. Such an arrangement allows application of force to the pressing zone 360 to cause disengagement of the locking tail flap 388*a* of the inner container or tray (which will be discussed later) from the locking edge 340. The demarcated pressing zone 365 is in substantial vertical alignment with the demarcated pressing zone 360. The pressing zone 365, however, is a decoy pressing zone in the illustrated embodiment since it is not in direct contact with the release tab 350. In an alternative embodiment, the pressing zone 365 may serve as an actual pressing zone for release of the inner tray. In such an embodiment, the outer shell may be formed with an inner top panel that is placed in flat face contact with the inside surface of the top panel 316. The inner top panel may provide an additional locking edge (for engagement with the locking tail flap 388*a*an additional release tab that is in alignment, and direct contact, with the pressing zone 365. Such an alternative outer shell may receive the inner container or tray 391 in either orientation, i.e., in the normal orientation in which the bottom wall 380 of the tray 391 is in flat face contact with the inner bottom panel 320 or in the inverted orientation in which the bottom wall 380 of the tray 391 is in flat face contact with the inner top panel.

In other embodiments, a sticker, self-adhesive label or the like may be applied to the package to provide and/or embellish the demarcated pressing zone.

Referring to blank 391, an inner slide container or tray (as is known) is formed by a series of folding operations to create a four-sided tray having a single tubular side wall and a locking tail flap that depends from the bottom wall 380 of the tray. A biaser tab 388*b* urges locking tail flap to project into an outward orientation relative to the bottom wall 380 of the tray ready for engagement with the engaging edge 330 of the outer tray. Briefly, the construction of the tray may be described as follows: glue panels 387 and biaser tab 388*b* are folded together with inner side panel 386 about fold line 385*a* to bring the glue flaps 387 into face contacting relationship with the inner face of the bottom panel 380. The glue panels 387 are adhered thereto. The biaser 388*b* is folded beneath the plane of the bottom panel 380 by pressing locking tail flap 388*a* out of the plane of the bottom panel 380 such that an aperture is formed. Erection of the tubular side wall is completed by raising the inner (386) and outer (384) side walls upwardly (about 90°) relative to the bottom panel 380. The upstanding tubular side wall (384, 385, 386) thereby formed is held in place with juxtaposed side panels 381*a*, 381*b*. Side panel 383 is kept in an upright position relative to side panels 381*a*, 381*b*, by the provision of glue flaps 383*a*, 383*b*.

In use, the tray is slidable into the outer shell 310 such that the locking tail flap 388*a* (in its outwardly urged position) becomes engaged with or catches on to the engaging edge provided by the inner bottom panel 320 of the outer shell 310. Release of the locking flap 388*a* is achieved by depression of the release tab 350. This is achieved by a user of the package squeezing in the region of the demarcated pressing zones and/or applying an appropriate downwardly directed force. Optionally, this is achieved by squeezing the package between in the region of the demarcated pressing zones 360, 365. A user is encouraged to apply a localised squeezing force by the provision of at least one of the demarcated pressing zones. It is realised that in providing a location point in the form of a demarcated pressing zone on the bottom and/or top of the container a user can comfortably grip the package between a thumb and forefinger and conveniently, their thumb and forefinger are located to optimise the effectiveness of the force the user applies in disengaging the lock. It will be recognised that the user cannot see the locking mechanism though the package, is not aware without investigation of its location or format. Therefore without a demarcated pressing zone a user may not know how to disengage the internally disposed security lock. Furthermore, if a user attempts to squeeze the package in the incorrect locations, damage of the articles and products retained therein could result. As such, the demarcated pressing zone(s) of the present invention guide a user to operate the package correctly and effectively. To that end, in some envisaged embodiments, the physical format of the top wall demarcated pressing zone and the physical format of a bottom wall demarcated pressing zone may complement one another (for example corresponding recess or dish and bump or raised portion so that a users thumb and forefinger can almost fit onto the package.

Figure 14A:
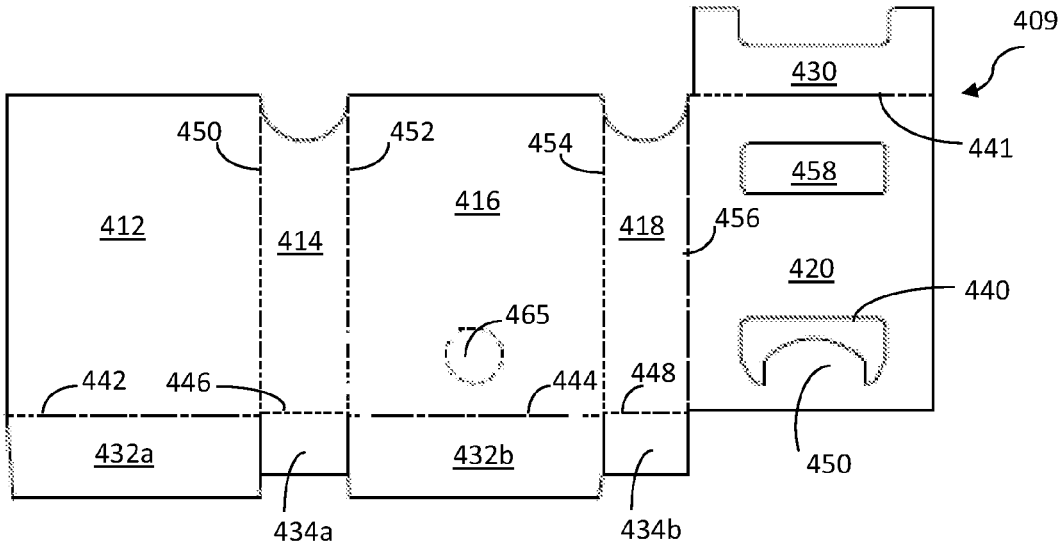
FIG. 14A. is a plan view of a blank of foldable sheet material cut, creased and arranged for forming an outer-shell type container according to a fifth embodiment of the invention.
Figure 15A:
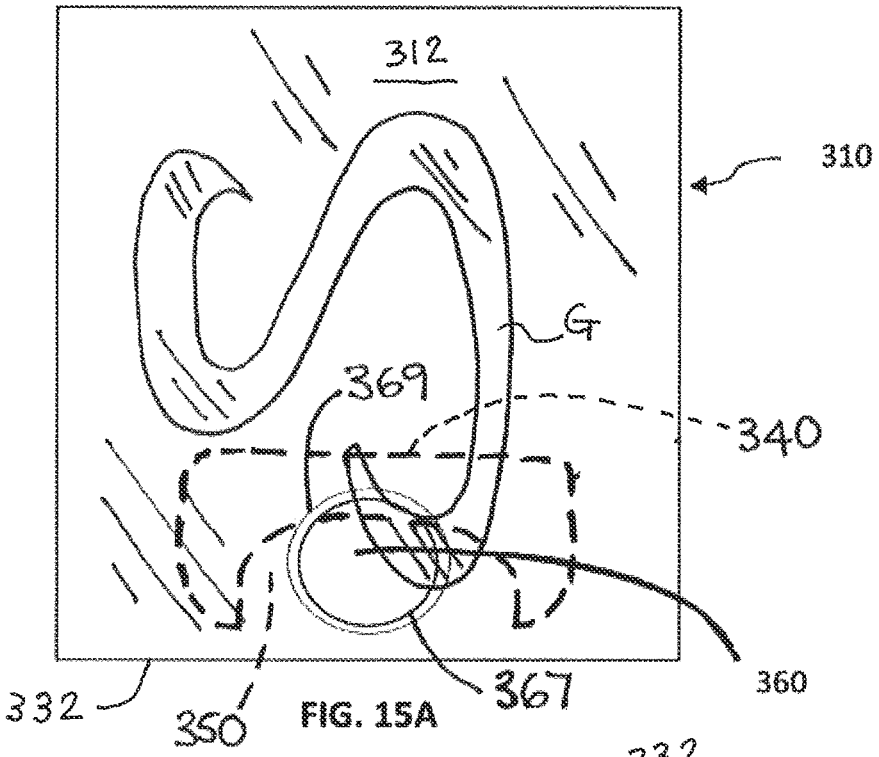
FIGS. 15A and 15B. are perspective top and bottom views respectively of an outer-shell type container formed from the blank of FIG. 14A.
Figure 15B:
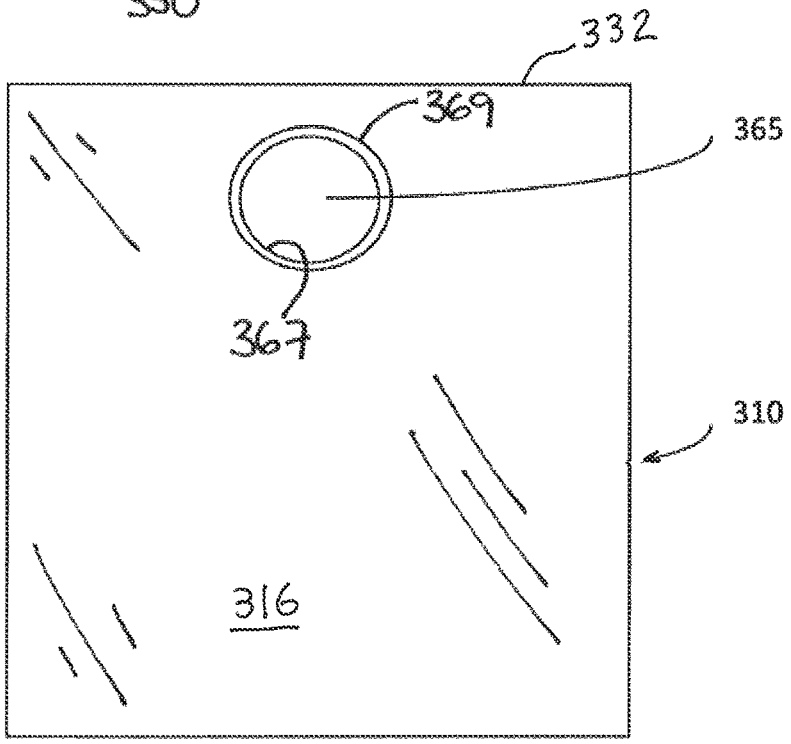

As is illustrated in FIG. 14A, in another envisaged embodiment of the invention, only one demarcated pressing zone may be provided. A single demarcated pressing zone 465 may optionally be formed in only the top panel or in only the bottom wall 416 of an outer shell, such as the outer shell formed from the blank 409 of FIG. 14A. The demarcated pressing zones 360, 365 and 465 as described above are effective because they encourage a user to apply force in the appropriate place on the package to cause disengagement of a locking flap from its abutment or catch with a locking edge (for example edge 440). Preferably, but nevertheless optionally, the demarcated pressing zone 360, 365, 465 is aligned and arranged to be close to, but preferably not overlapping with the engaging edge 340, 440. This optional feature is described further with reference to FIG. 13A. Relative to notional line drawn though the locking edge 340 and along the blank 13A (see line X3 in FIG. 13A), the demarcated pressing zones 360, 365 may be described as: spaced from and not overlapping the engaging edge 340; and/or offset from that notional line X3 toward the rear of the outer shell; and/or overlapping an inner release tab 350 (optionally provided by the inner bottom panel 320). Further optionally a centre of the demarcated pressing zone may correspond to a focal point for the desired force to be applied for effecting disengagement of the locking flap from its catch with the engaging edge 340, 440. The focal point or centre of the at least one demarcated pressing zone may optionally be in the centre of the outer shell with reference to the width of the outer shell (in other words approximately centrally positioned across the panel 312, 412, 314). The focal point or centre of the at least one demarcated pressing zone may optionally be closer to the rear end wall of the outer shell than the engaging edge is to the rear end wall of the outer shell.

Figure 16A:
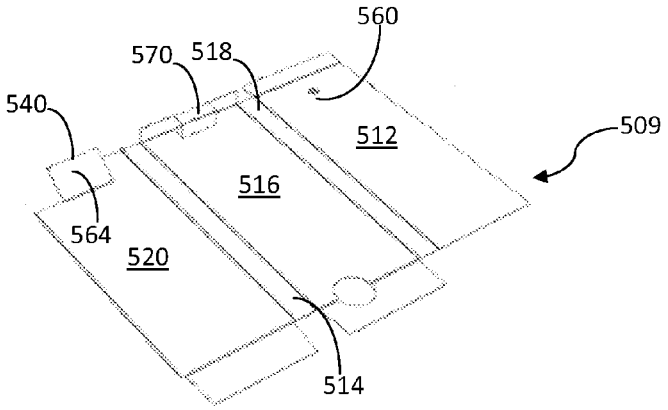
FIG. 16A. is a perspective view of a blank of material cut, creased and partly folded in the process of forming an outer-shell type container according to a sixth embodiment of the invention.
Figure 16B:
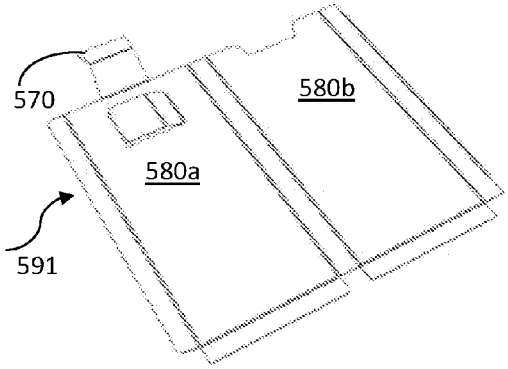
FIG. 16B. is a perspective view of a blank of material cut, creased and partly folded in the process of forming an inner receptacle for use in the outer shell type container formed from the blank of FIG. 16A (and optionally other suitable outer shells)
Figure 16C:
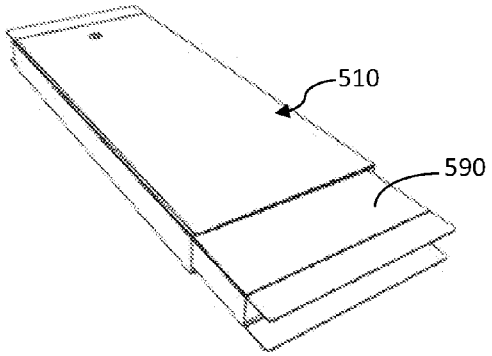
FIG. 16C. is a part-constructed package comprising an outer-shell formed from the blank of FIG. 16A and an inner slide card.

With reference to FIGS. 16A and 16B a further embodiment of the invention will be briefly described in the context of an outer shell and inner receptacle. A part-formed blank 509 for forming an outer shell is shown, which comprises: an outer top panel 512, a bottom panel 516 and an inner top panel 520. The outer top panel 512 comprises a demarcated pressing zone 560 which provides a latent pressure point which is beneficial because unlike typical release tabs, the outer most top panel 512 is free of any cuts of tears that could be torn out or that could allow the ingress of dirt. As with the preceding embodiments, the demarcated pressing zone 560 may be decorated, shaped, press-formed or otherwise formed as required to further disguise its presence or alternatively to highlight its presence. The inner top panel 520 has an engaging edge 540 formed from a folded over panel 564. The blank 591 for forming an inner receptacle that is optionally cooperative with the outer shell type container 510 (see FIG. 16C) formed from comprises a top panel 580*a* and a bottom panel 580*b*. An outer surface of the top panel 580*a* is provided with an arrangement of flaps for forming a locking post or locking projection, using which the inner receptacle 591 will catch the engaging edge 540 provided by flap 564 of the outer shell 510. In use, the inner receptacle 590 can be used to house or contain articles and can be stowed within the outer sleeve 510. To withdraw the inner receptacle 590 pressure must be applied to the package in the vicinity of the locking post 570, to depress the locking post 570 out of engagement with the edge 540. To disengage the inner receptacle, the outer shell has a specific location that must be depressed to cause the catch flap to fall below (or out of alignment with) the catch edge 570. Proper positioning of the demarcated pressing zone on either the outer top panel 512 as illustrated and/or the bottom panel 516 guides a user in a discrete manner to squeeze or otherwise apply appropriately positioned pressure.

Figure 17:
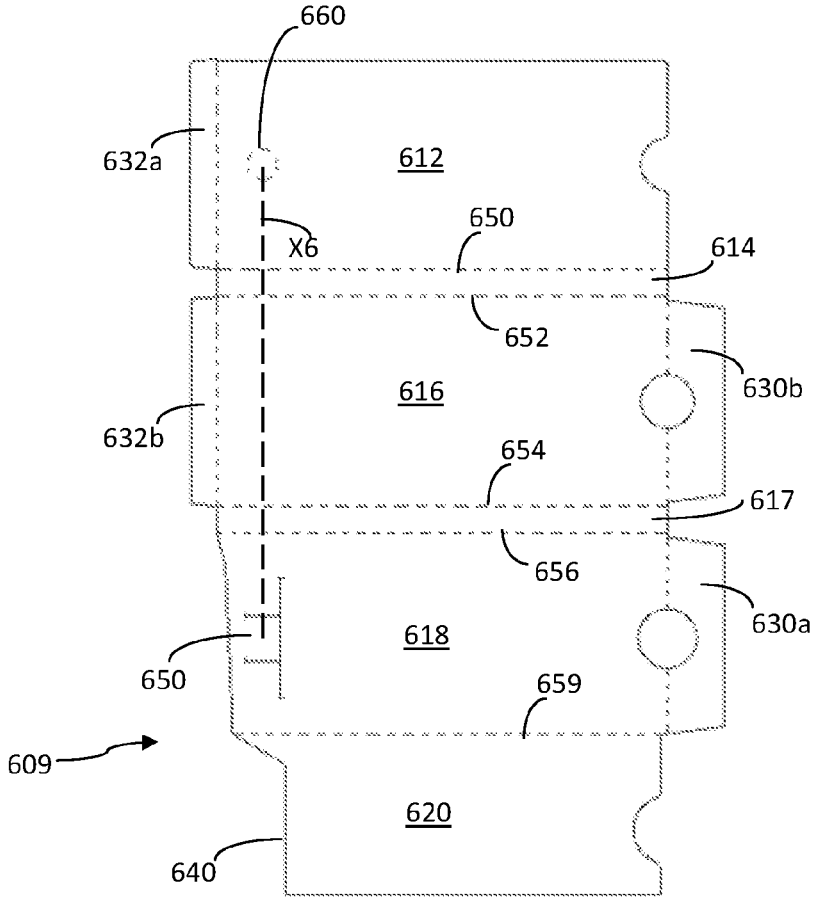
FIG. 17. is a plan view of a blank cut, creased and arranged for forming an outer-shell type container according to a seventh embodiment of the invention.
Figure 17A:
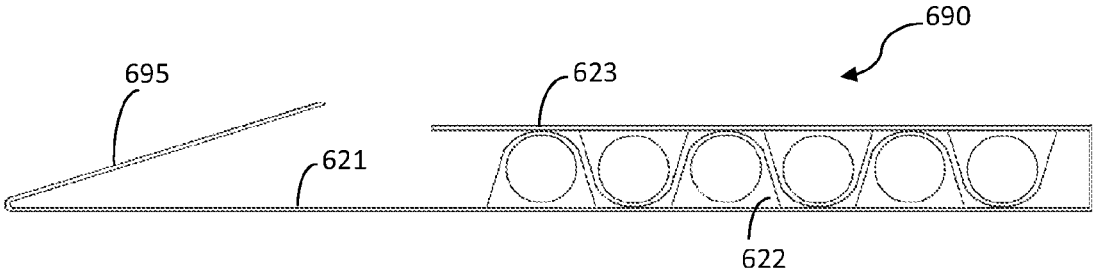
FIG. 17A. is a cross-sectional view of an inner slide card of the type having a locking tail flap for use with an outer-shell formed from the blank of FIG. 17 in forming a sleeve-and-drawer style package according to an embodiment of the invention.
Figure 18A:
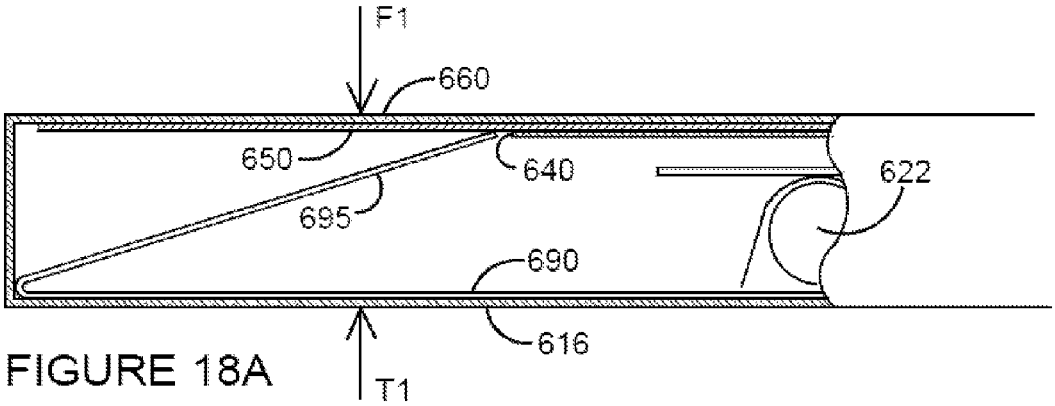
FIG. 18A. is a cross-sectional view of such a sleeve-and-drawer style package showing the engagement of the locking tail flap with the outer-shell type container.
Figure 18B:
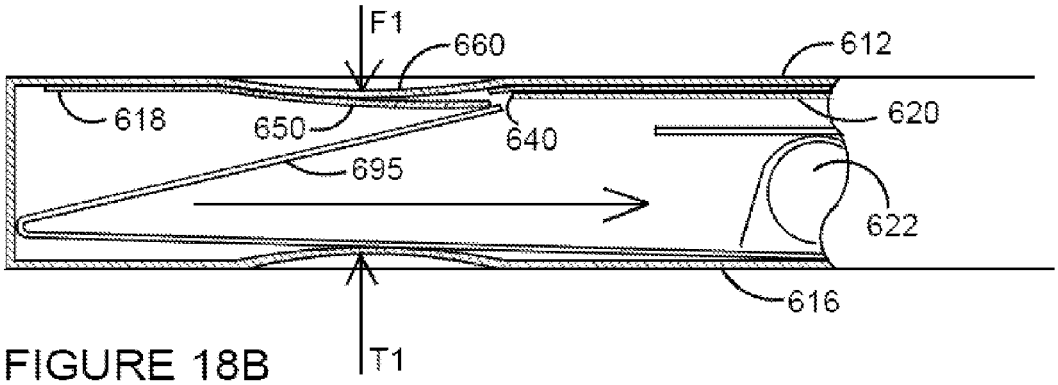
FIG. 18B. is a cross-sectional view of the package of FIG. 18A illustrating the unlocking operation of the package.

Yet further examples of the positioning and application of one or more demarcated pressing zones will be described with reference to FIGS. 17 to 20B. In FIG. 17 a blank 609 for forming an outer shell type container for use in creating a sleeve-and-drawer style package (shown in cross-section only in FIGS. 18A and 18B) is shown. An optional inner release tab 650 is formed by an arrangement of appropriately sized and positioned cut lines. The tab 650 is depressible out of the plane of the inner top panel 618 and is provided to transfer a downwardly applied force to the locking tail flap 695 of an inner receptacle 690 (see FIG. 17A for a cross-sectional view of the inner receptacle; FIG. 18A for a cross-section of the package in a closed and locked positioned; and FIG. 18B for an illustration of the unlocking of the inner receptacle 690 from the outer shell). A demarcated pressing zone 660 is positioned such that its centre is directly over or at least substantially over the centre of the release tab 650. This alignment is illustrated in FIG. 17 by means of dashed notional line X6. The centre of the demarcation line is off-set from the engaging edge 640 and off-set closer to the rear-closed-end 632*a*/632*b* of the outer shell. The front end of the outer shell is open and is edged by inwardly folded panels 630*a*, 630*b*.

Figure 19:
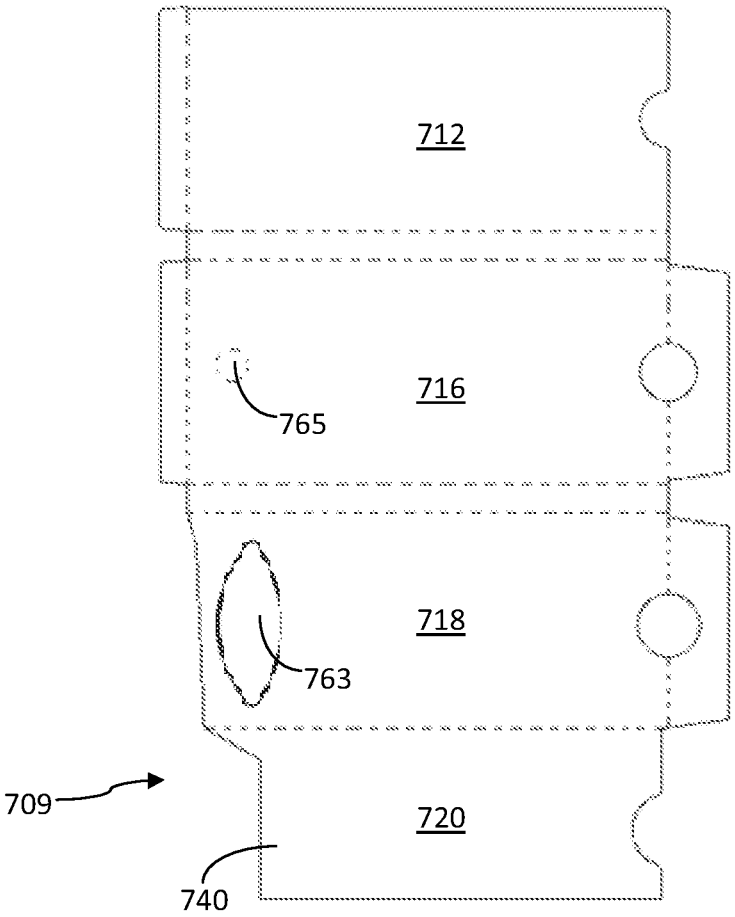
FIG. 19. is a plan view of the blank of material cut, creased and arranged for forming an outer-shell type container according to an eighth embodiment of the invention.
Figure 20A:
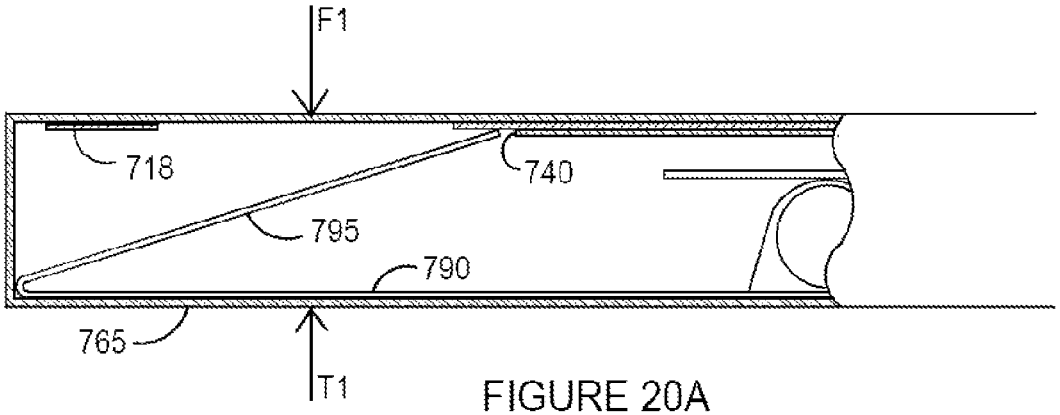
FIG. 20A. is a cross-sectional view of such a sleeve-and-drawer style package showing the engagement of the locking tail flap with the outer-shell type container.
Figure 20B:
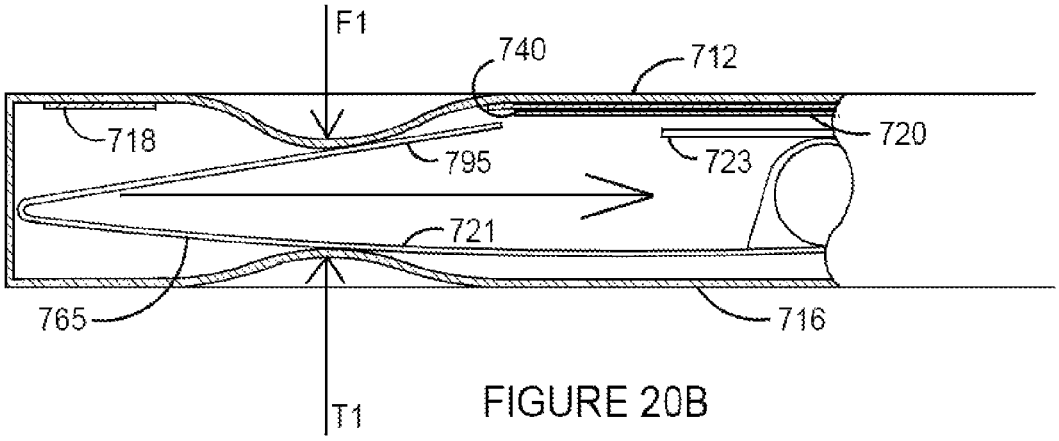
FIG. 20B. is a cross-sectional view of the package of FIG. 20A illustrating the unlocking operation of the package.

A user may optionally apply force to the package by squeezing the package between their thumb and forefinger (as illustrated by inwardly directed arrows T1 and F1). The provision of the demarcated pressing zone shows a user or encourages a user where to direct a force for unlocking the inner receptacle 690. The guidance provided by the demarcated pressing zone may be written; pictorially illustrated; and/or provided by a depression, embossment, creased circle. Optionally the demarcated pressing zone 660 may be positioned only on the outer top panel 612 or as in the next illustrated embodiment in FIGS. 19 to 20B, the demarcated pressing zone 765 may be provided only on a bottom panel 716 of an outer-sleeve style container. Alternatively demarcated pressing zones may be provided on both top and bottom panels. It will be understood that depending upon the manner in which the locking mechanism operates, the demarcated pressing zone will be positioned and sized and arranged accordingly. As such, if a locking mechanism comprises two separate locking features, each of which requires disengagement or release an inner receptacle, then the outer sleeve style container may be provided with more than one demarcated pressing zone. Furthermore, it will be understand from consideration of FIGS. 19 to 20B, that the presence of an internal release tab (such as tab 150, 350, 450, 650) is an optional element and may be substituted by an apertured panel, by no inner top panel or by a plain inner top panel. In FIG. 19 a blank 709 is shown wherein the inner top panel 718 is an aperture inner top panel 718 having an aperture 763 formed proximate the engaging edge 740 for being in proximate vertical alignment therewith in the erect outer-shell such that when a force is applied by squeezing the bottom panel 716 and outer top panel 712 in the region of the demarcated pressing zone 765, the top panel 712 and optionally the bottom panel 716 are caused to bow or be depressed sufficiently to cause disengagement of the locking tail flap 795 from the engaging edge 740 as is illustrated in FIG. 20B.

While the present invention has been described in terms of specific embodiments thereof, it will be understood that no limitations are intended thereby to the details of construction or design, the present invention contemplating and including any novel feature or novel combination of features which are herein disclosed.

It can be appreciated that various changes may be made within the scope of the present invention, for example, the size, number, configuration, position and relative placement, shape and physical formation of the at least one demarcated pressing zone may be adjusted to suit the locking mechanism and/or size and/or color and/or design and/or intended purpose of the package. Preferably, the entire pressing zone does not overlap (in superposition) with the engaging edge or engaging mechanism provided, however, in some embodiments there may be an overlap. Preferably, the centre (width-ways) of the demarcated pressing zone is aligned with the centre (width-ways) of an internal release tab when provided.

The at least one demarcated pressing zone may comprise any one or more of: an embossment, debossment, crease, groove, compressed region of material, integrally formed raised button or recess. Optionally the demarcated region may be formed by anyone or more or an appropriate combination of: thermo-forming, molded, blow-molded, pressed, grooved, engraved, cored, hatched, It will be recognized that as used herein, directional references such as "top", "bottom", "front", "back", "end", "side", "inner", "outer", "upper" and "lower" do not limit the respective panels to such orientation, but merely serve to distinguish these panels from one another. Any reference to hinged connection should not be construed as necessarily referring to a single fold line only; indeed it is envisaged that hinged connection can be formed from one or more of the following, a short slit, a frangible line or a fold line without departing from the scope of the invention.

The invention claimed is:

1. A package comprising an outer container and an inner receptacle, the outer container forming a cavity for the inner receptacle having an access end through which the inner receptacle can be inserted, the package comprising a two-part locking mechanism for locking the inner receptacle within the cavity of the outer container, the outer container comprising a first part of the two-part locking mechanism, the inner receptacle comprising a second part of the two-part locking mechanism, wherein the outer container comprises a top wall and a bottom wall hingedly connected together by a pair of side panels and at least one demarcated pressing zone, the top wall comprising a top panel, the bottom wall comprising inner and outer bottom panels, the at least one demarcated pressing zone being provided in at least one of the top panel and the outer bottom panel, the first part of the locking mechanism being provided the inner bottom panel, wherein the at least one demarcated pressing zone is configured to encourage a user to apply a force directed inwardly of the outer container toward the cavity for deactivating the locking mechanism so that the inner receptacle is released for withdrawal of the inner receptacle at least partially from the outer container, and wherein the at least one demarcated pressing zone is defined at least in part by graphical indicia printed on the at least one of the top panel and the outer bottom panel.

2. A package according to claim 1 wherein an external surface of the outer container is free of a full-depth cut.

3. A package according to claim 1 wherein the outer bottom panel is hingedly connected by one of the side panels to one of opposed side edges of the top panel and wherein the inner bottom panel is hingedly connected by the other of the side panels to the other of the side edges of the top panel.

4. A package according to claim 1, wherein the at least one demarcated pressing zone comprises two demarcated pressing zones, wherein a first of the two demarcated pressing zones is printed on an external face of the top panel and wherein the second of the two demarcated pressing zones is printed on an external face of the outer bottom panel and wherein the external faces are spaced apart and disposed opposite to one another.

5. A package according to claim 1 wherein the top wall and a bottom wall are hingedly connected by the side panels to form a sleeve structure for defining the cavity, sleeve structure having front and rear opposed ends, the rear end being closed, the front end providing the access end of the outer container.

6. A package according to claim 1 wherein the at least one demarcated pressing zone is arranged to encourage a user to apply a localised force and wherein the package is arranged such that a localized force applied to the at least one demarcated pressing zones causes disengagement of the locking mechanism.

7. A package according to claim 1 wherein the at least one demarcated pressing zone simulates a shape selected from the group consisting of a circle, irregular shape, polygonal, oval and elliptic.

8. A package according to claim 1 wherein the at least one demarcated pressing zone comprises a physical formation and wherein the physical formation is any one or more or a combination of: an embossment, a debossment, a groove, a compression, a half-depth cut, a raised button, a recessed button.

9. A package according to claim 1 wherein the inner bottom panel is placed along the inside surface of the outer bottom panel, the first part of the locking mechanism is an engaging edge provided by the inner bottom panel and wherein the second part of the locking mechanism is a flap that can catch onto the engaging edge in order to lock the inner receptacle within the outer container, the locking flap being hingedly connected to the remainder of the inner receptacle.

10. A package according to claim 1 wherein the at least one demarcated pressing zone is further defined by a depression made in the at least one of the top panel and the outer bottom panel, and wherein the depression is covered by the graphical indicia.

11. A package according to claim 10 wherein the depression is formed by compressing a shape into material of the at least one of the top panel and the outer bottom panel.

12. A package according to claim 5 wherein the first part of the locking mechanism comprises an engaging, edge provided by the inner bottom panel, and wherein the at least one demarcated pressing zone does not overlap in super-position with the engaging edge.

13. A package according to claim 12 wherein the at least one demarcated pressing zone is positioned closer to the rear end of the sleeve than the engaging edge.

14. A package according to claim 12 wherein the engaging edge is provided by part of a perimeter of an aperture in the inner bottom panel.

15. A package comprising an outer container and an inner receptacle, the outer container forming a cavity for the inner receptacle having an access end through which the inner receptacle can be inserted, the package comprising a two-part locking mechanism for locking the inner receptacle within the cavity of the outer container, the outer container comprising a first part of the two-part locking mechanism, the inner receptacle comprising a second part of the two-part locking mechanism, wherein the outer container comprises a top wall and a bottom wall hingedly connected together by a pair of side panels and at least one demarcated pressing zone, the top wall comprising a top panel, the bottom wall comprising inner and outer bottom panels, the at least one demarcated pressing zone being provided in at least one of the top panel and the outer bottom panel, the first part of the locking mechanism being provided by the inner bottom panel, wherein the at least one demarcated pressing zone is configured to encourage a user to apply a force directed inwardly of the outer container toward the cavity for deactivating the locking mechanism so that the inner receptacle is released for withdrawal of the inner receptacle at least partially from the outer container, and wherein the at least one demarcated pressing zone is defined at least in part by a depression made in the at least one of the top panel and the outer bottom panel.

16. A package according to claim 15 wherein the depression is formed by compressing a shape into material of the at least one of the top panel and the outer bottom panel.

17. A blank for forming an outer container for lockably receiving an inner receptacle, the outer container comprising a sleeve structure having a closed rear end and a front access end, and a locking mechanism for engaging the inner receptacle in the sleeve structure, the blank comprising an outer bottom panel hingedly connected by a first side panel to one of opposed side edges of a top panel, an inner bottom panel hingedly connected by a second side panel to the other of the opposed side edges of the top panel, and at least one demarcated pressing zone provided in at least one of the top panel and the outer bottom panel, the locking mechanism comprising an engaging edge provided by the inner bottom panel, wherein the at least one demarcated pressing zone is configured to encourage a user to apply a force directed inwardly of the sleeve structure for disengaging the inner receptacle from the locking mechanism so that the inner receptacle is released for withdrawal of the inner receptacle at least partially from the outer container, and wherein the at least one demarcated pressing zone is defined at least in part by a depression made in the at least one of the top panel and the outer bottom panel.

18. A blank according to claim 17 wherein the depression is formed by compressing a shape into material of the at least one of the top panel and the outer bottom panel.

19. A blank according to claim 18 wherein the at least one demarcated pressing zone is further defined by graphic indicia printed on the at least one of the top panel and the outer bottom panel, the graphic indicia covering the depression.

20. A blank according to claim 17 wherein the rear end of the sleeve is defined by respective rear end edges of the top panel and the inner and outer bottom panels, and wherein the at least one demarcated pressing zone is offset from a notional line toward the rear end edges, the notional line extending coincidentally with the engaging edge of the inner bottom panel.

* * * * *